US008491085B2

(12) United States Patent
Asano et al.

(10) Patent No.: US 8,491,085 B2
(45) Date of Patent: Jul. 23, 2013

(54) IMAGE FORMING APPARATUS

(75) Inventors: Yukihiro Asano, Miyagi (JP); Katsuaki Ono, Miyagi (JP); Yusuke Nemoto, Miyagi (JP); Daisuke Hasebe, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 215 days.

(21) Appl. No.: 13/040,437

(22) Filed: Mar. 4, 2011

(65) Prior Publication Data

US 2011/0221821 A1 Sep. 15, 2011

(30) Foreign Application Priority Data

Mar. 10, 2010 (JP) ..... 2010-053072

(51) Int. Cl.
*B41J 2/165* (2006.01)

(52) U.S. Cl.
USPC ..... 347/22; 347/29; 347/33

(58) Field of Classification Search
USPC ..... 347/22, 23, 29, 32–34, 40, 20, 42, 347/49
See application file for complete search history.

(56) References Cited

U.S. PATENT DOCUMENTS 6,123,407 A 9/2000 Muraki
6,592,200 B2 * 7/2003 Wotton et al. ..... 347/22
6,595,619 B2 * 7/2003 Barinaga et al. ..... 347/32
7,841,691 B2 11/2010 Yamada
2001/0012028 A1 8/2001 Nitta
2008/0174631 A1 7/2008 Habashi
2008/0231655 A1 9/2008 Yamada
2009/0179928 A1 7/2009 Nemoto et al.

FOREIGN PATENT DOCUMENTS

EP 0785084 A2 7/1997
JP 2005-111939 4/2005
JP 2008-229982 10/2008
JP 2008-307714 12/2008
JP 2009-202491 9/2009

OTHER PUBLICATIONS

Aug. 10, 2011 European search report in connection with counterpart European patent application No. 11 15 6871.

* cited by examiner

*Primary Examiner* — Thinh Nguyen
(74) *Attorney, Agent, or Firm* — Cooper & Dunham LLP

(57) ABSTRACT

Disclosed is an image forming apparatus that includes plural recording heads that eject liquid droplets and plural maintenance units that correspond to the plural recording heads. The plural maintenance units are capable of separately moving between opposed positions opposed to the plural recording heads and retracted positions not opposed to the plural recording heads, and the plural maintenance units are retracted into the retracted positions in postures different from postures at the opposed positions.

4 Claims, 28 Drawing Sheets

IMAGE FORMING APPARATUS

BACKGROUND OF THE INVENTION

1. Field of the Invention

The present invention relates to an image forming apparatus and, in particular, to an image forming apparatus having heads that eject liquid droplets.

2. Description of the Related Art

As an image forming apparatus such as a printer, a facsimile machine, a copier, a plotter, and a multi-task machine having plural such functions, a known image forming apparatus of a liquid ejection recording type uses a recording head that ejects, for example, ink liquid droplets. The image forming apparatus of this type ejects ink droplets onto a paper (not limited to a paper but including a member such as OHP to which ink droplets and other liquids can be attached; it is also referred to as a medium to be recorded on, a recording medium, a recording paper, a recording sheet, or the like) during conveyance from the recording head to perform image formation (used synonymously with recording, printing, and imaging). Examples of the image forming apparatus include serial-type image forming apparatuses in which a recording head ejects liquid droplets to form an image while moving in a main scanning direction and line-type image forming apparatuses using a line-type head in which a recording head ejects liquid droplets to form an image without moving.

Note that in the present invention, an "image forming apparatus" of a liquid ejection type refers to an apparatus that ejects ink onto a medium such as a paper, a thread, a fiber, a fabric, leather, metal, a plastic, glass, wood, and a ceramic so as to perform image formation. Further, "image formation" refers to forming not only relevant images such as characters and graphics but also irrelevant images such as patterns on a medium (i.e., only the ejection of liquid droplets onto a medium). Further, "ink" is not limited to one as generally called ink but is used as a generic name of various liquids available for image formation such as recording liquid, fixing treatment liquid, and liquid. Examples of the ink include DNA samples, resist, and pattern materials. Further, "images" are not limited to two-dimensional images but also refer to images added to three-dimensional objects and images obtained by shaping objects into three dimensions.

In such an image forming apparatus (hereinafter simply referred to as an "ink jet recording apparatus"), a recording head ejects ink from nozzles onto a paper to perform recording. Thus, due to an increase in the viscosity of the ink caused by the evaporation of a solvent from the nozzles, solidification of the ink, attachment of dust, mixture of air bubbles, or the like, the recording head is brought into an ejection failure state where recording failure is caused. Therefore, the image forming apparatus has a maintenance and restoration mechanism (maintenance unit) that maintains and restores the performance of the recording head.

For example, the maintenance and restoration mechanism has a cap unit (also referred to as a cap unit, a cap member, or the like) that seals the nozzles of the recording head. The cap unit is configured to cap the recording head when the image forming apparatus does not operate, thereby making it possible to prevent the ink inside the nozzles from drying and thickening. Further, in order to reduce the ejection failure of the ink, the maintenance and restoration mechanism is generally configured to appropriately perform a maintenance operation in which air bubbles, thickened ink, or the like are forcibly ejected from the nozzles of the recording head. The drainage of the ink thus ejected is ejected into the cap unit, and nozzle surfaces after being subjected to the maintenance operation are wiped and cleaned by a blade unit.

As a conventional image forming apparatus, Patent Document 1 discloses one having a head for ejecting black droplets and a head for ejecting color droplets and a maintenance and restoration unit that separately maintains and restores the heads.

Further, Patent Document 2 discloses one having head units in which plural ink heads are arranged in lines so as to be laid one on another and having cap units arranged at positions opposed to ink ejection surfaces and sealing nozzle lines. The head units are evenly arranged with spaces along their conveyance direction, and the cap units are retracted into their spaces at the time of ink ejection.

Moreover, Patent Document 3 discloses one having a maintenance unit including a holding member that holds sealing members in contact with the nozzle surfaces of a head. The holding member is capable of moving between a sealing position where the sealing members seal the nozzle surfaces and a retracted position where the sealing members are accommodated below a conveyance path, and is foldable between the sealing members. The holding member is extended upward at the sealing position and folded at the retracted position.

Furthermore, Patent Document 4 discloses one having one or more maintenance mechanisms that perform a maintenance operation on a head and a maintenance unit that retracts the one or more maintenance mechanisms so as to be vertically laid one on another above a position where a recording medium is conveyed at the time of ejection and on at least one of the supply side and the ejection side of the recording medium and then moves the maintenance mechanisms in a direction parallel to the conveyance direction of the recording medium.

Patent Document 1: JP-A-2009-202491
Patent Document 2: JP-A-2005-111939
Patent Document 3: JP-A-2008-229982
Patent Document 4: JP-A-2008-307714

However, in the conventional image forming apparatuses described above, the posture of the maintenance unit remains the same between a position opposed to the head and a position not opposed to the head. Therefore, the maintenance unit requires a large retracting space, which results in the size of the apparatuses being increased.

That is, in the image forming apparatuses having the plural recording heads that eject liquid droplets in, for example, a downward direction and the plural maintenance units having the cap units opposed to the plural recording heads from bottom sides thereof, when the maintenance units are horizontally moved to retracted positions, a retracting space corresponding to the widths of the maintenance units in a medium conveyance direction is required.

SUMMARY OF THE INVENTION

The present invention has been made in view of the above problems and may have an object of reducing the retracting space of plural maintenance units and downsizing an apparatus.

According to an aspect of the present invention, there is provided an image forming apparatus including plural recording heads that eject liquid droplets and plural maintenance units that correspond to the plural recording heads. The plural maintenance units are capable of separately moving between opposed positions opposed to the plural recording heads and retracted positions not opposed to the plural recording heads, and the plural maintenance units are retracted into the retracted positions in postures different from postures at the opposed positions.

According to another aspect of the present invention, there is provided an image forming apparatus including a first recording head that ejects monochromatic liquid droplets; a second recording head that ejects plural different colors of liquid droplets; a first maintenance unit that corresponds to the first recording head; and plural second maintenance units that correspond to the second recording head. The first maintenance unit is capable of moving between an opposed position opposed to the first recording head and a retracted position not opposed to the first recording head, the plural second maintenance units are capable of separately moving between opposed positions opposed to the second recording head and retracted positions not opposed to the second recording head, and the plural second maintenance units are retracted into the retracted positions in postures different from postures at the opposed positions.

Other objects, features and advantages of the present invention will become more apparent from the following detailed description when read in conjunction with the accompanying drawings.

BRIEF DESCRIPTION OF THE DRAWINGS

FIGS. 21A and 21B are explanatory views for explaining the operations control;

DETAILED DESCRIPTION OF THE PREFERRED EMBODIMENTS

Next, referring to the accompanying drawings, an embodiment of the present invention is described. First, referring to a schematic explanatory view shown in FIG. 1, a description is made of the brief overview of an image forming apparatus according to the embodiment of the present invention.

Figure 1:
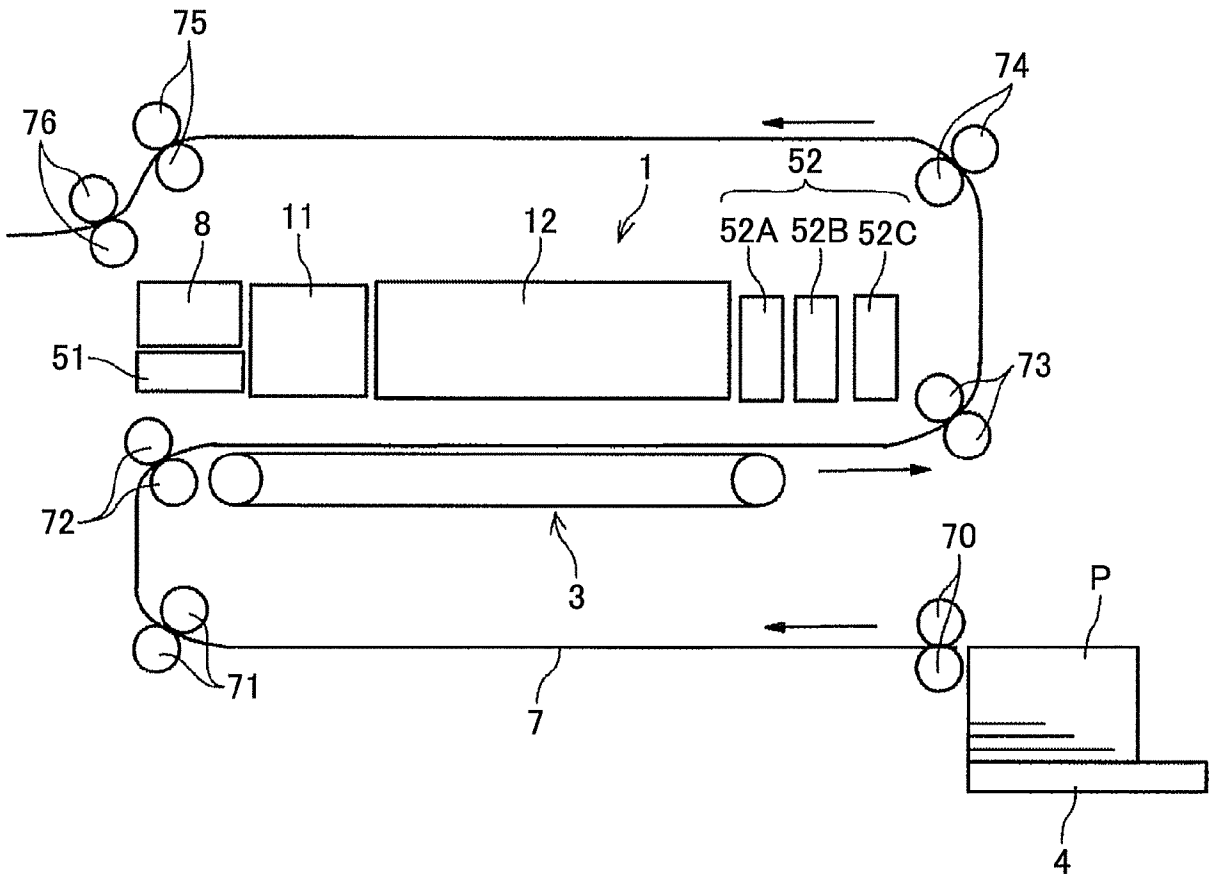
FIG. 1 is a schematic explanatory view for explaining the entire configuration of an image forming apparatus according to an embodiment of the present invention.

The image forming apparatus is a line-type image forming apparatus and has, as shown in FIG. 1, an image forming part 1 including a first recording head unit 11 acting as a first recording head that ejects monochromatic liquid droplets and a second recording head unit 12 acting as a second recording head that ejects plural colors of liquid droplets; a conveyance part 3 acting as a conveyance unit that conveys a paper P opposing the image forming part 1; a paper feeding part 4 that feeds the paper P to the conveyance part 3; a first maintenance unit 51 corresponding to the first recording head unit 11 of the image forming part 1; second maintenance units 52A through 52C corresponding to the second recording head unit 12; a cleaning unit 8 that cleans the first maintenance unit 51; and the like. The image forming apparatus conveys the paper P fed out from the paper feeding part 4 by a pair of paper feeding rollers 70 to the conveyance part 3 via a conveyance path 7 and pairs of conveyance rollers 71 and 72, causes the paper P on which an image is formed to pass through pairs of conveyance rollers 73, 74, and 75, and ejects the paper P onto a paper ejection tray (not shown) via a pair of paper ejection rollers 76. Note that the conveyance path 7 is an inverted S-shaped path as a whole.

Figure 2:
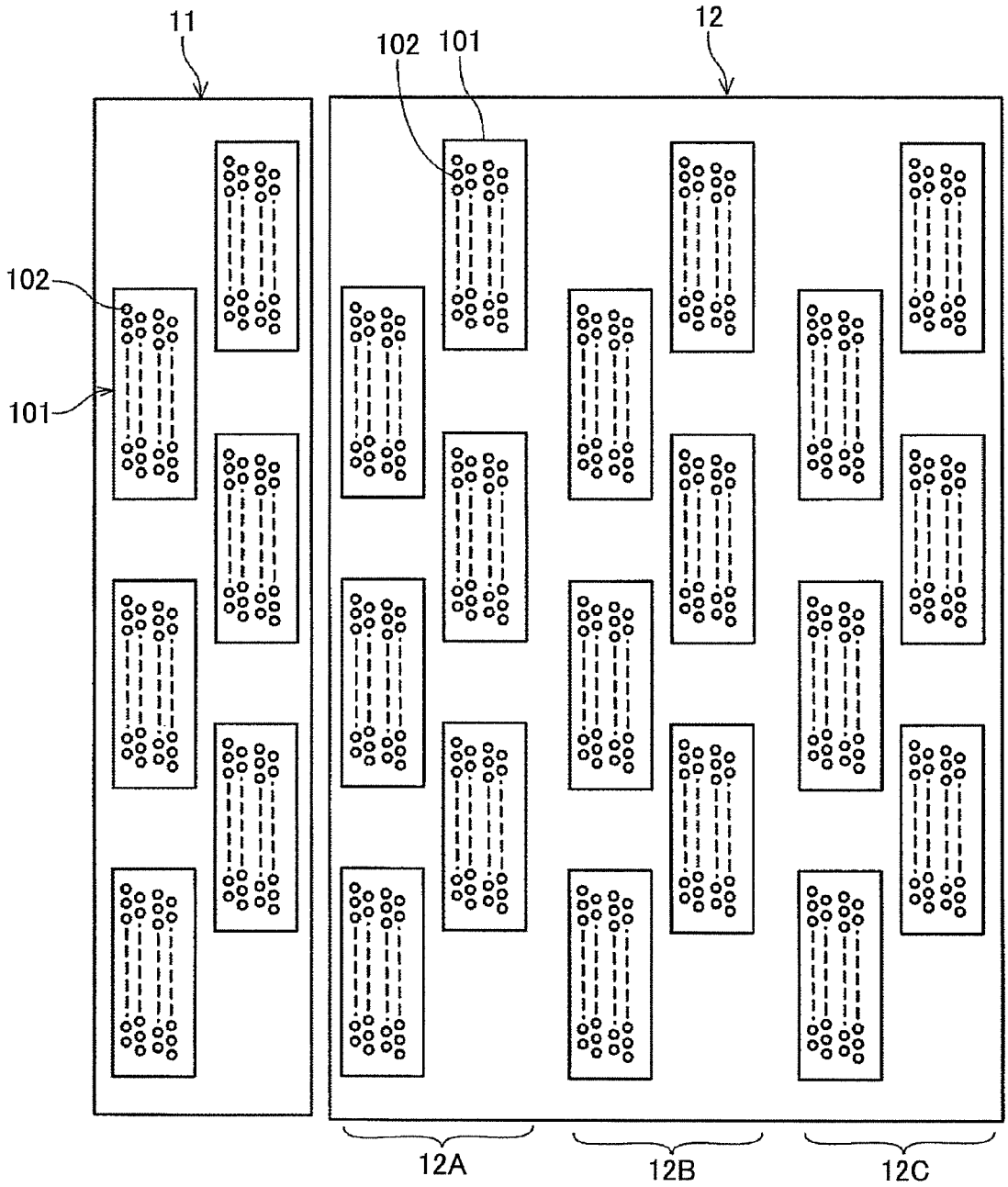
FIG. 2 is a plan explanatory view of recording head units in an image forming part.
Figure 3:
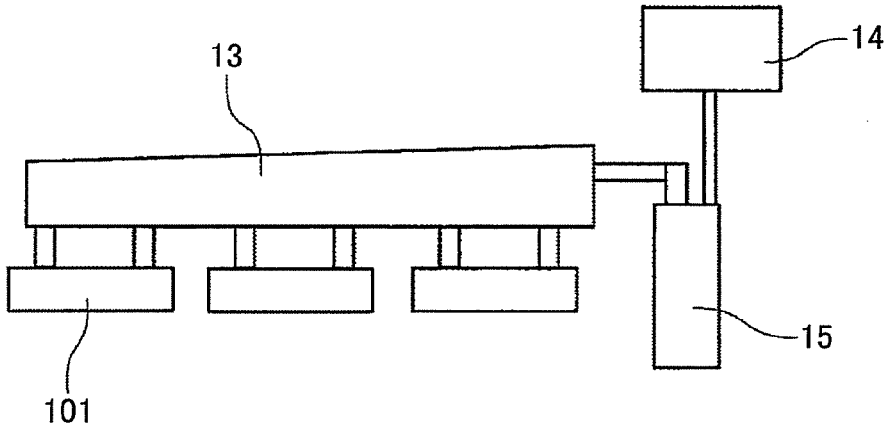
FIG. 3 is a schematic explanatory view for explaining an ink supply system corresponding to one line of heads in the image forming part.

Next, referring to FIGS. 2 and 3, a description is made of the image forming part 1. Note that FIG. 2 is a plan explanatory view of the recording head units of the image forming part 1, and FIG. 3 is a schematic explanatory view for explaining an ink supply system corresponding to one line of the heads in the recording head unit of the image forming part 1.

As shown in FIG. 2, the first recording head unit 11 of the image forming part 1 has one head line in which six heads (three heads in each line) 101, each of which has plural nozzles 102 for ejecting liquid droplets arranged in four lines, are arranged zigzag in two lines in a nozzle arrangement direction. The first recording head unit 11 forms a nozzle-line width corresponding to one line with the six heads 101 and ejects, for example, black (K) liquid droplets.

Further, as shown in FIG. 2, the second recording head unit 12 has three groups of two head lines in which six heads (three heads in each line) 101, each of which has the plural nozzles 102 for ejecting liquid droplets arranged in four lines, are arranged zigzag in two lines in the nozzle arrangement direction. Here, the three groups of two head lines are called second head units 12A, 12B, and 12C, respectively. The second head units 12A, 12B, and 12C of the second recording head unit 12 eject, for example, cyan (C), magenta (M), and yellow (Y) liquid droplets, respectively.

Further, as shown in FIG. 3, each of the recording head units 11 and 12 has a distribution member 13 that distributes ink to the three heads 101 forming the one line, and the ink is supplied to the distribution member 13 from a sub-tank 15 into which the ink is resupplied from a main tank 14. Note that since two lines of the heads 101 form the one line, the distribution members 13 are provided for the respective head lines and connected to the sub-tanks 15 of corresponding colors.

The first recording head unit 11 and the second recording head unit 12 (collectively referred to as a "recording head unit 10") are provided in a manner capable of being moved up and down.

Figure 4:
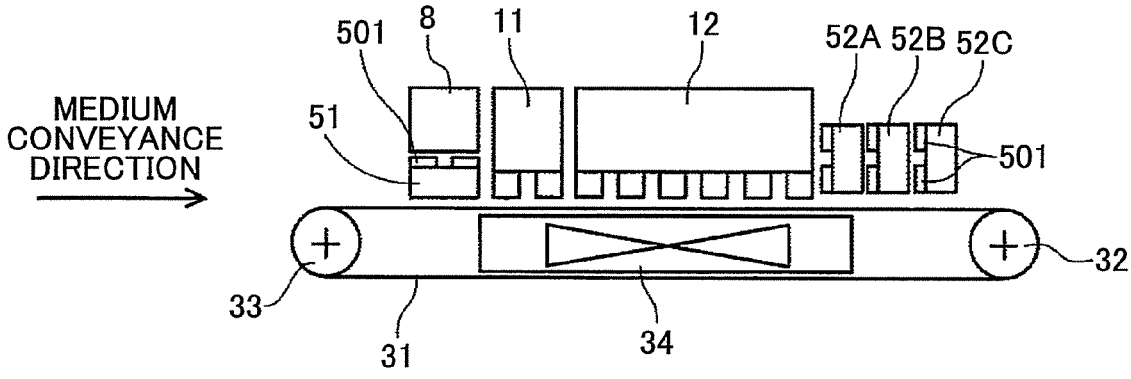
FIG. 4 is a front explanatory view of the image forming part and a conveyance part.

Next, referring to FIG. 4, a description is made of the conveyance part 3. Note that FIG. 4 is a front explanatory view of the image forming part 1 and the conveyance part 3.

The conveyance part 3 has a conveyance belt 31 that conveys the paper P opposing the image forming part 1. The conveyance belt 31 is an endless belt bridged across a conveyance driving roller 32 and a conveyance driven roller 33 and has plural holes (not shown) formed at its front surface. Inside the conveyance belt 31, an air attraction fan (suction fan) 34 that suctions the paper P is provided. When the conveyance belt 31 circularly moves with the rotation of the conveyance driving roller 32 driven by a motor (not shown), the paper P is suctioned onto the conveyance belt 31 by the suction fan 34 and conveyed with the circular movement of the conveyance belt 31. Note that the attraction of the paper P is not limited to suctioning but the paper P may be held on the conveyance belt 31 by electrostatic attraction, adhesion, or the like.

Figure 5:
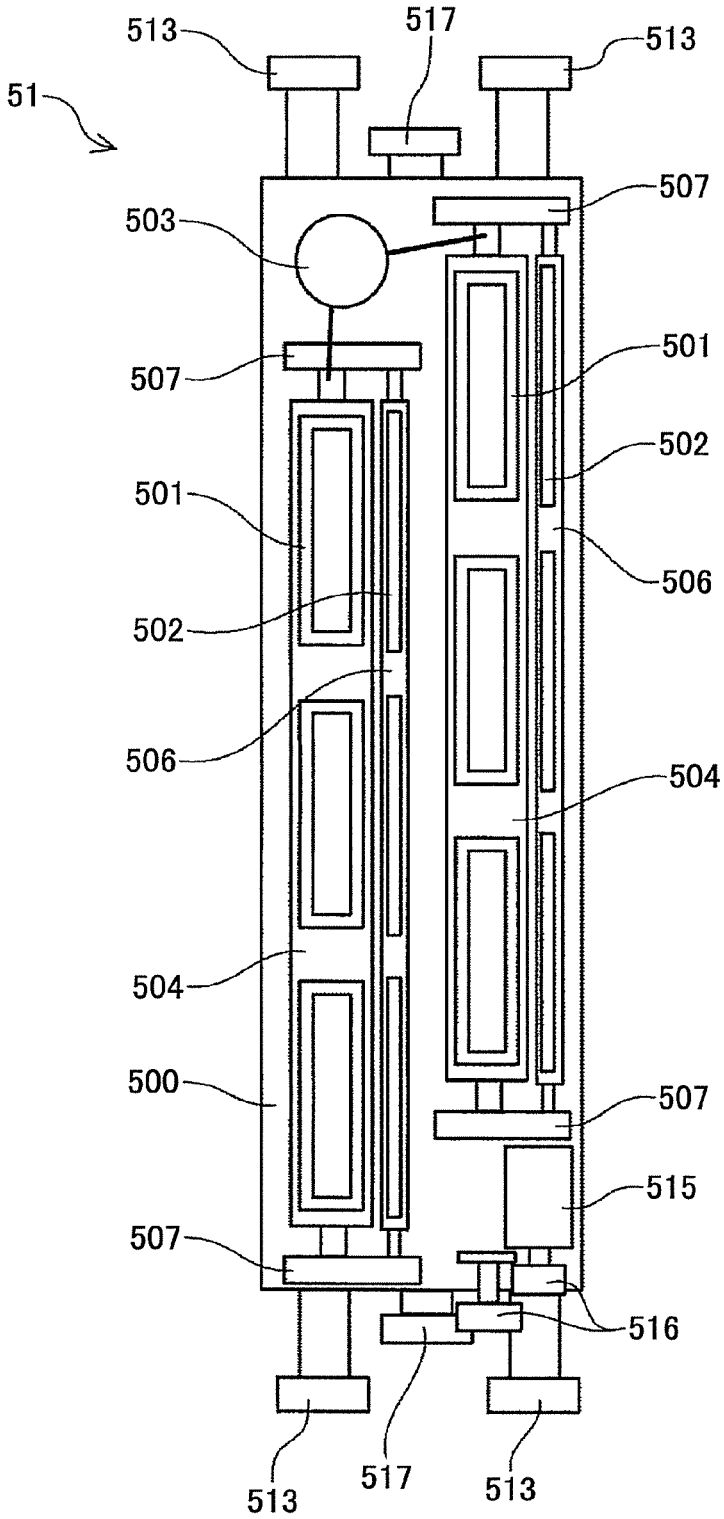
FIG. 5 is a plan explanatory view of a first maintenance unit.
Figure 6:
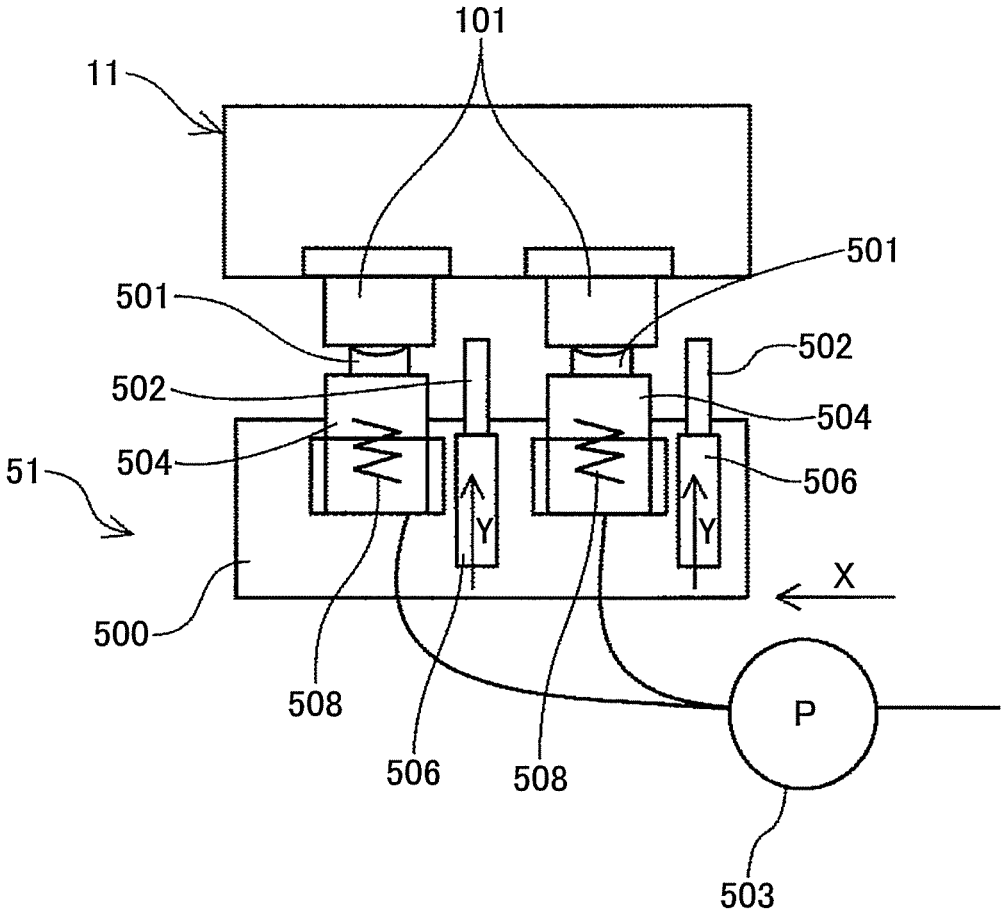
FIG. 6 is a front explanatory view of the first maintenance unit.

Next, referring to FIGS. 5 and 6, a description is made of the first maintenance unit 51. Note that FIG. 5 is a plan explanatory view of the first maintenance unit 51, and FIG. 6 is a front explanatory view thereof.

The first maintenance unit 51 has, on a base member 500, cap units 501 that cap the respective heads 101 of the first recording head unit 11, blade units 502 that wipe off the nozzle surfaces (surfaces in which the nozzles are formed) of the respective heads 101, and a suction pump (suction unit) 503 (shown outside the base member 500 in FIG. 6) connected to the respective cap units 501.

Here, the three cap units 501 corresponding to the one line of the heads are held on a common cap holder 504, and springs 508 are interposed between the cap units 501 and the cap holder 504. The cap units 501 are pressed and lowered by a predetermined amount against the springs 508 when coming into contact with the nozzle surfaces of the heads 101. Thus, with the biasing force of the springs 508, the cap units 501 reliably come into contact with the nozzle surfaces. Further, the three blade units 502 corresponding to the one line of the heads are held on a common blade holder 506. The blade units 502 are moved by a moving mechanism (here, by a moving up-and-down mechanism) (not shown). In wiping off the nozzle surfaces of the heads 101, the blade units 502 move up in a direction as indicated by arrows Y and then the first maintenance unit 51 moves in a direction as indicated by arrow X. Note that the respective cap holders 504 and the blade holders 506 are held between frames 507.

The cap units 501 of the first maintenance unit 51 have both the function of moisturizing the respective heads 101 of the first recording head unit 11 as moisture retention caps and the function of restoring the respective heads 101 of the first recording head unit 11 and the second recording head unit 12.

In other words, the cap units 501 of the first maintenance unit 51 act as the moisture retention caps that come into contact with the nozzle surfaces of the respective heads 101 of the first recording head unit 11 to moisturize the heads 101. In addition, the cap units 501 act as suction caps into which ink is forcibly suctioned and ejected from the nozzles 102 of the heads 101 in such a manner that the suction pump 503 is driven to maintain the caps at negative pressure with the nozzle surfaces of the respective heads 101 of the first recording head unit 11 and the second recording head unit 12 capped. Further, the cap units 501 act as ejection caps that receive ink ejected when a restoration operation is performed to pressure-feed the ink to the heads 101 so as to be forcibly pressure-ejected. Furthermore, the cap units 501 act as idle ejection receivers used when an idle ejection operation is performed to eject liquid droplets irrelevant to image formation.

Figure 7:
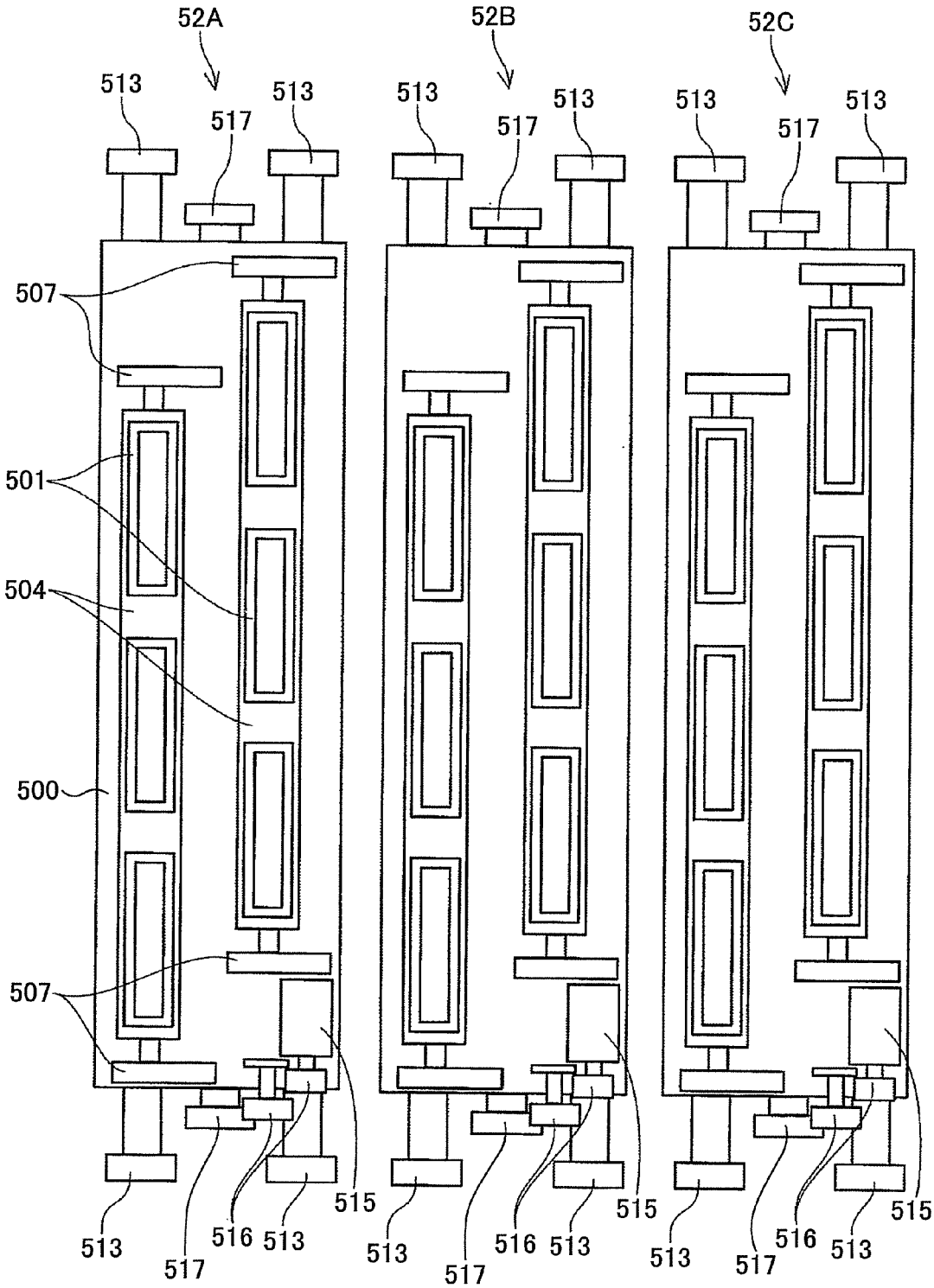
FIG. 7 is a plan explanatory view of second maintenance units.
Figure 8:
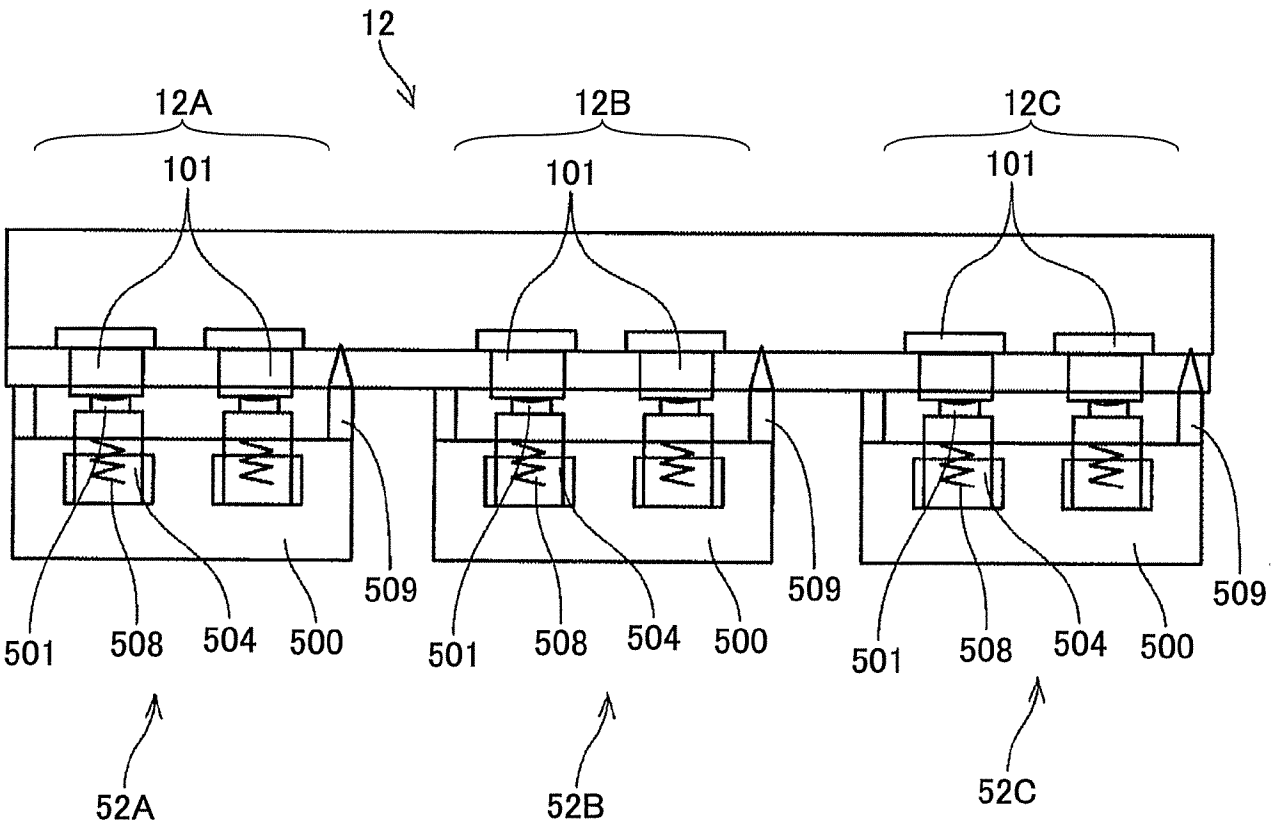
FIG. 8 is a front explanatory view of the second maintenance units.

Next, referring to FIGS. 7 and 8, a description is made of the second maintenance unit 52. Note that FIG. 7 is a plan explanatory view of the second maintenance unit 52, and FIG. 8 is a front explanatory view thereof.

The second maintenance unit 52 is composed of the three second maintenance units 52A, 52B, and 52C corresponding to the second head units 12A, 12B, and 12C of the second recording head unit 12, respectively.

Each of the second maintenance units 52A, 52B, and 52C has, on the base member 500, the cap units 501 that cap the respective heads 101 of the second head units 12A through 12C. The three cap units 501 corresponding to the one line of the heads 101 are held on the common cap holder 504, and springs 508 are interposed between the cap units 501 and the cap holders 504. The cap units 501 are pressed and lowered by a predetermined amount against the springs 508 when coming into contact with the nozzle surfaces of the heads 101. Thus, with the biasing force of the springs 508, the cap units 501 reliably come into contact with the nozzle surfaces. Note that the respective cap holders 504 are held between the frames 507.

The cap units 501 of the second maintenance units 52A through 52C have only the function of moisturizing the respective heads 101 of the second head units 12A through 12C as moisture retention caps.

Further, the second maintenance units 52A through 52C have positioning pins 509 that engage with positioning holes (not shown) provided on the side of the second recording head unit 52 so as to align the cap units 501 with the respective heads 101 of the second head units 12A through 12C of the second recording head unit 52.

Figure 9:
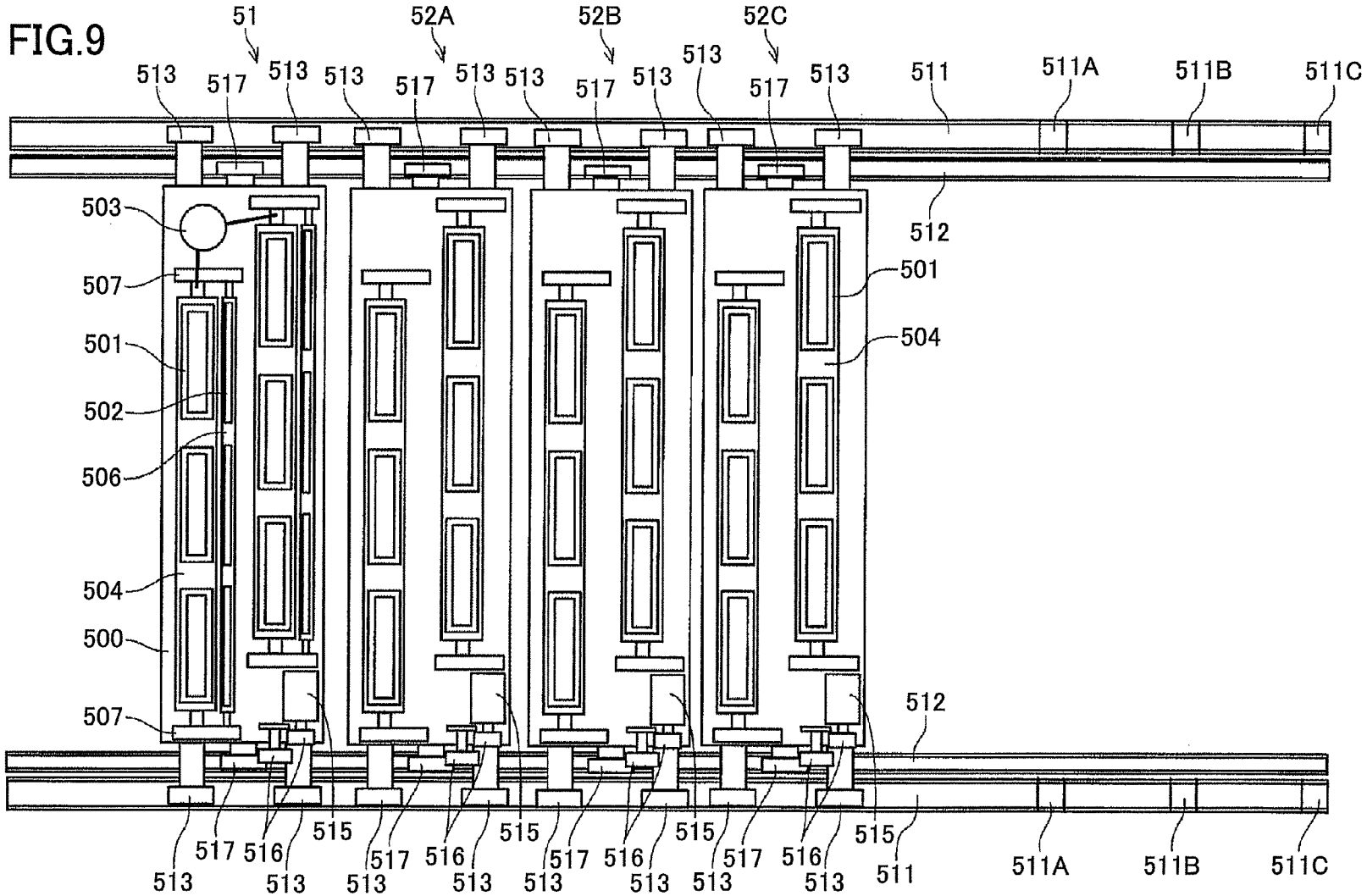
FIG. 9 is a plan explanatory view for explaining the moving unit (moving mechanism) of the first maintenance unit and the second maintenance units.
Figure 10:
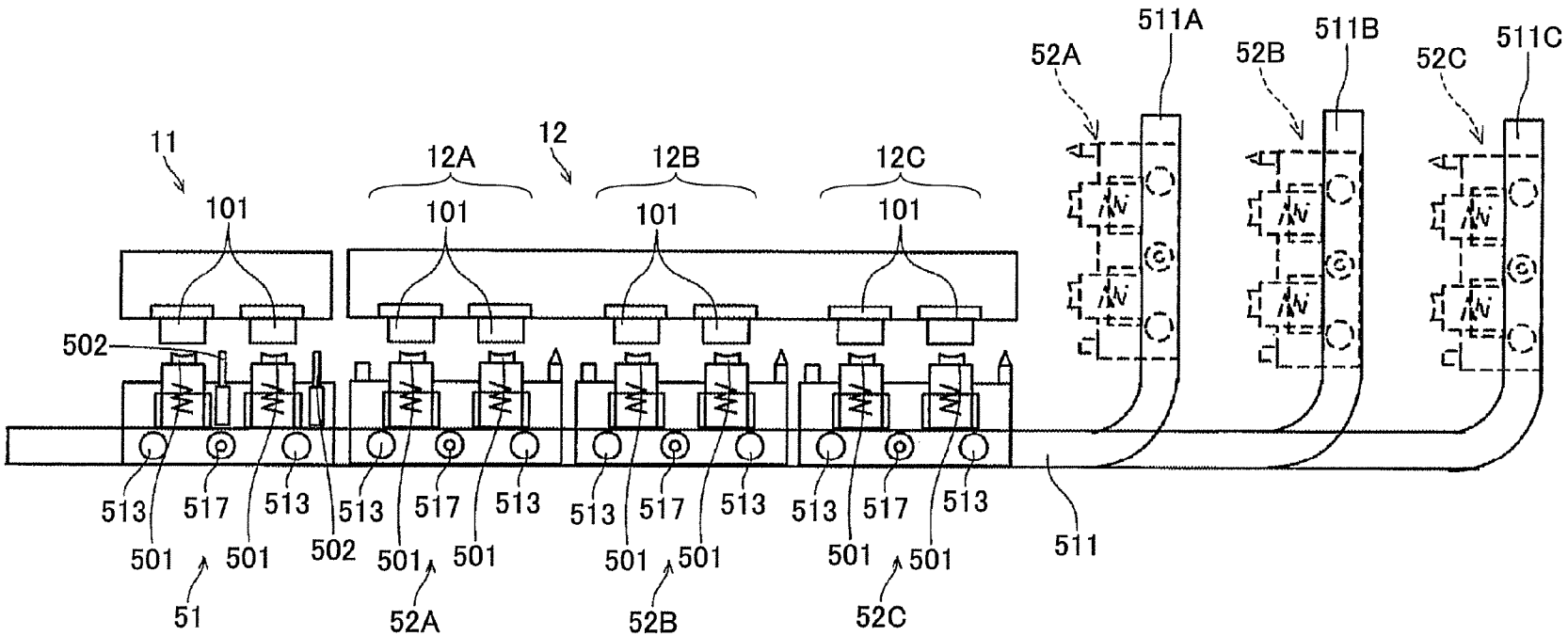
FIG. 10 is a front explanatory view of the moving mechanism.

Next, referring to FIGS. 9 and 10, a description is made of the moving unit (moving mechanism) of the first maintenance unit 51 and the second maintenance unit 52. Note that FIG. 9 is a plan explanatory view for explaining the moving mechanism, and FIG. 10 is a front explanatory view of the moving mechanism.

First, guide rails 511 are provided along a recording-medium conveyance direction, and racks 512 are provided inside the respective guide rails 511. Note that although the left parts of the guide rails 511 and the racks 512 are omitted in FIGS. 9 and 10 for convenience sake, the guide rails 511 and the racks 512 are extended so that the first maintenance unit 51 can move to a position lateral to the first recording head unit 11 on the upstream side of the recording-medium conveyance direction.

The first maintenance unit 51 is mounted on the guide rails 511 in a manner capable of being moved by guide rollers 513 rotatably provided at the both end parts of the base member 500 in a direction orthogonal to the recording-medium conveyance direction. Further, the first maintenance unit 51 has a driving motor 515 provided on the base member 500 and pinions 517 rotated and driven by the driving motor 515 via a gear train 516, and the pinions 517 engage the racks 512. Thus, the first maintenance unit 51 can travel along the guide rails 511 by itself when the driving motor 515 is rotated and driven, and move between an opposed position opposed to the first recording head unit 11 and a retracted position not opposed to the first recording head unit 11.

Like the first maintenance unit 51, the second maintenance units 52A through 52C are mounted on the guide rails 511 in a manner capable of being moved by the guide rollers 513 rotatably provided at the both end parts of the base members 500 in the direction orthogonal to the recording-medium conveyance direction. Further, the second maintenance units 52A through 52C have the driving motors 515 provided on the base members 500 and the pinions 517 rotated and driven by the driving motors 515 via the gear trains 516, and the pinions 517 engage with the racks 512. Thus, the second maintenance units 52A through 52C can travel along the guide rails 511 by themselves when the driving motors 515 are rotated and driven, and move between opposed positions opposed to the second head units 12A through 12C of the second recording head 12 and retracted positions not opposed to the second head units 12A through 12C of the second recording head 12.

Next, referring to FIGS. 4 and 9 again, a description is made of the retracted positions and retracted postures of the first maintenance unit 51 and the second maintenance unit 52.

The first maintenance unit 51 horizontally moves between the opposed position opposed to the heads 101 and the retracted position not opposed to the heads 101. The retracted position of the first maintenance unit 51 is lateral to the first recording head unit 11 on the upstream side of the recording-medium conveyance direction, and the retracted posture of the first maintenance unit 51 is the same as the posture thereof at the opposed position.

Meanwhile, as shown in FIG. 10, accommodation guide rail parts 511A, 511B, and 511C formed by raising the end parts of the guide rails 511 are provided at the position lateral to the second recording head unit 12 on the downstream side of the recording-medium conveyance direction so as to accommodate the second maintenance units 52A through 52C. The accommodation guide rail parts 511A, 511B, and 511C are set as the retracted positions of the second maintenance units 52A through 52C. Therefore, as indicated by solid lines in FIG. 10, the postures (on standby) of the second maintenance units 52A through 52C at the retracted positions are different from the postures (where the cap units 501 are directed upward) of the second maintenance units 52A through 52C at the opposed positions. In other words, as indicated by broken lines in FIG. 10, the second maintenance units 52A through 52C are retracted into the retracted positions in the postures in which the second maintenance units 52A through 52C are rotated by 90 degrees at the opposed positions (the postures where the cap units 501 are directed to the recording-medium conveyance direction). When the second maintenance units 52A through 52C are retracted (on standby), they are held in their rising posture and arranged parallel side by side in the recording-medium conveyance direction.

As described above, the postures of the second maintenance units 52A through 52C at the retracted positions are different from the postures of the second maintenance units 52A through 52C at the opposed positions. For example, the second maintenance units 52A through 52C are held in their rising postures when they are retracted into the retracted positions. Accordingly, even if the widths of the second maintenance units 52A through 52C in the recording-medium conveyance direction are greater than the heights of the second maintenance units 52A through 52C, the second maintenance units 52A through 52C require a smaller space in the recording-medium conveyance direction than a space required when the second maintenance units 52A through 52C are retracted in the same postures as when they are opposed to the heads 101. Further, the heights of the second maintenance units 52A through 52C can be reduced as compared with a case where they are retracted so as to be laid one on another.

In other words, where the second maintenance units 52A through 52C are configured to be retracted into the retracted positions in the postures different from the postures at the opposed positions, the retracting spaces of the maintenance units 52A through 52C can be made smaller, thereby attaining the downsizing of the apparatus.

Note that although the second maintenance units 52A through 52C are held in their rising postures at the retracted positions, they may be held in their, for example, oblique postures from the viewpoint of the heights and widths (in a moving direction), the sizes of allowable retracted spaces, or the like of the second maintenance units 52A through 52C.

Figure 11:
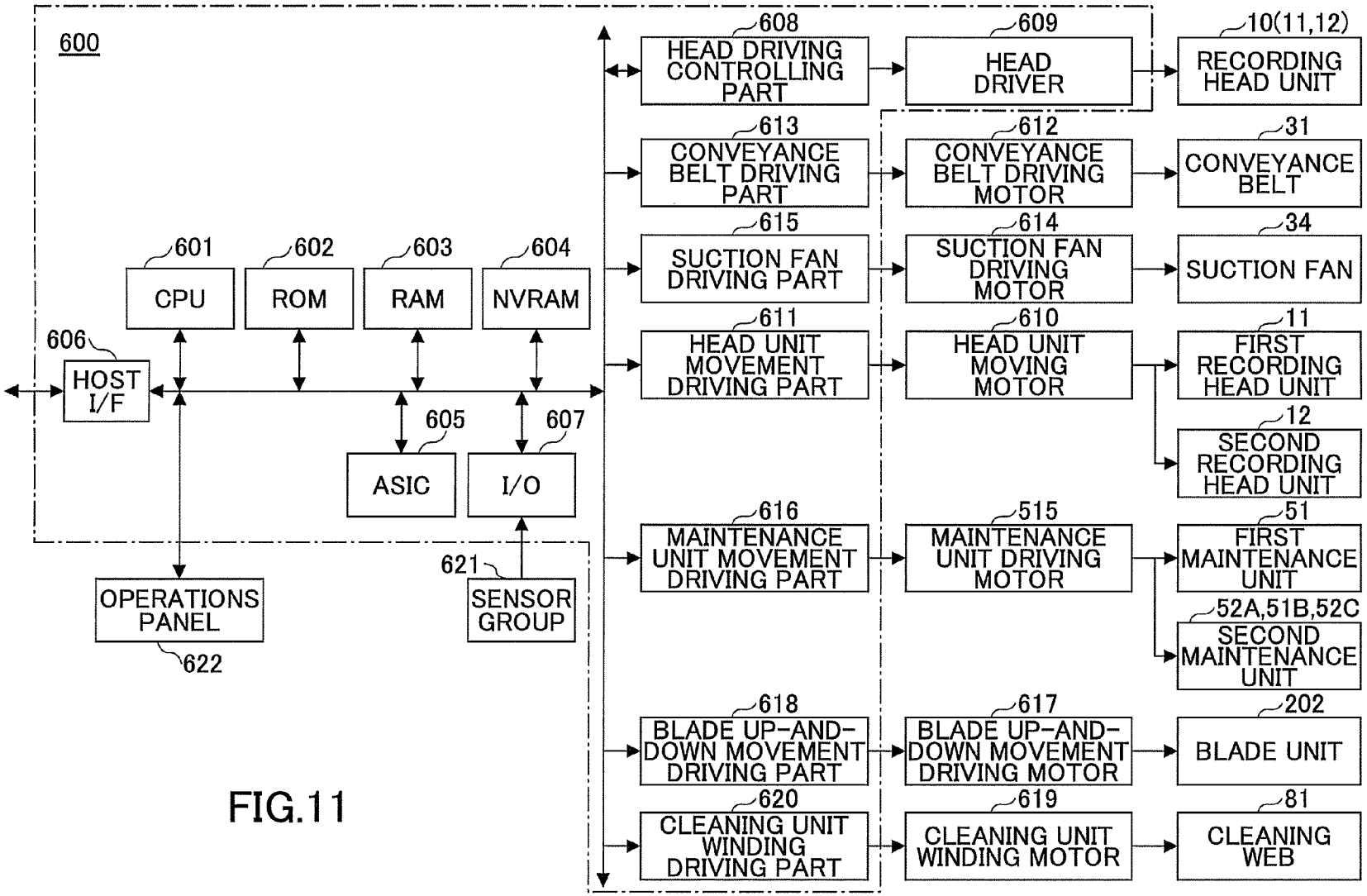
FIG. 11 is a block diagram showing the brief overview of the control unit of the image forming apparatus.

Next, referring to a block diagram shown in FIG. 11, a description is made of the brief overview of the control unit 600 of the image forming apparatus.

The control unit 600 has a CPU 601 that controls the entirety of the image forming apparatus; a ROM 602 that stores a program executed by the CPU 601 and other fixed data; a RAM 603 that temporarily stores image data or the like; a non-volatile memory (NVRAM) 604 that maintains data even where the power of the apparatus is turned off; an ASIC 605 that processes the input/output of controlling the entireties of other apparatuses; a host I/F 606 that sends and receives data and signals to and from a host; a head driving controlling part 608 that drives and controls the respective heads 101 of the first recording head unit 11 and the second recording head unit 12 of the image forming part 1; and a head driver 609.

In addition, the control unit 600 has a head unit movement driving part 611 that drives a head unit moving motor 610 to move up/down the first recording head unit 11 and the second recording head unit 12; a conveyance belt driving part 613 that drives a conveyance belt driving motor 612 to drive the conveyance belt 31; a suction fan driving part 615 that drives a suction fan driving motor 614 to drive the suction fan 34; a maintenance unit movement driving part 616 that drives the respective driving motors 515 of the first maintenance unit 51 and the second maintenance units 52A through 52C; a blade up-and-down movement driving part 618 that drives a blade up-and-down movement driving motor 617 to move up/down the blade units 502; a cleaning unit winding driving part 620 that drives a winding motor 619 to wind cleaning webs 81 of the cleaning unit 8; an I/O 607 to which various detection signals from an environment sensor group 621 or the like that detects an environmental temperature and humidity are input; and the like. Further, the control unit 600 outputs and inputs desired information to an operations panel 622.

Next, referring to FIGS. 12A through 15C, a description is made of the operations of the maintenance units 51 and 52A through 52C of the image forming apparatus.

Figure 12A:
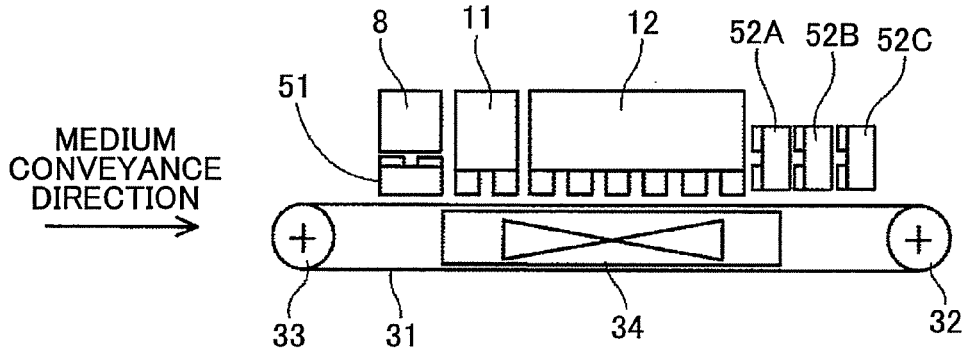
FIGS. 12A through 12C are explanatory views for explaining the operations of the maintenance units in the image forming apparatus.
Figure 12B:
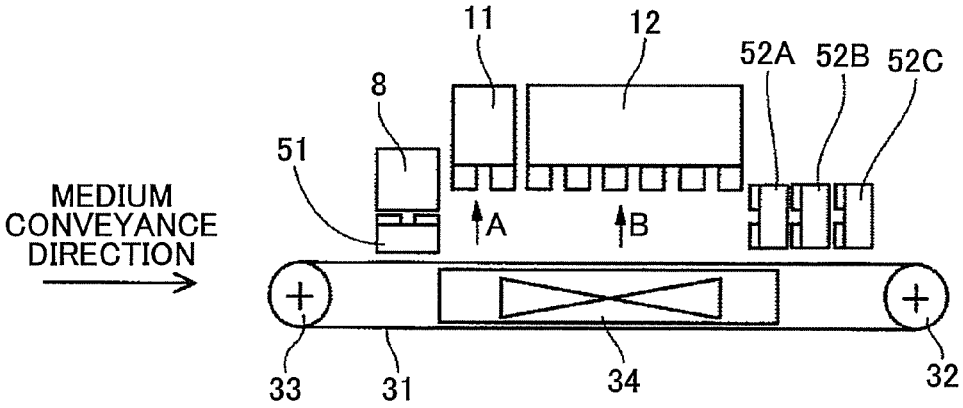
Figure 12C:
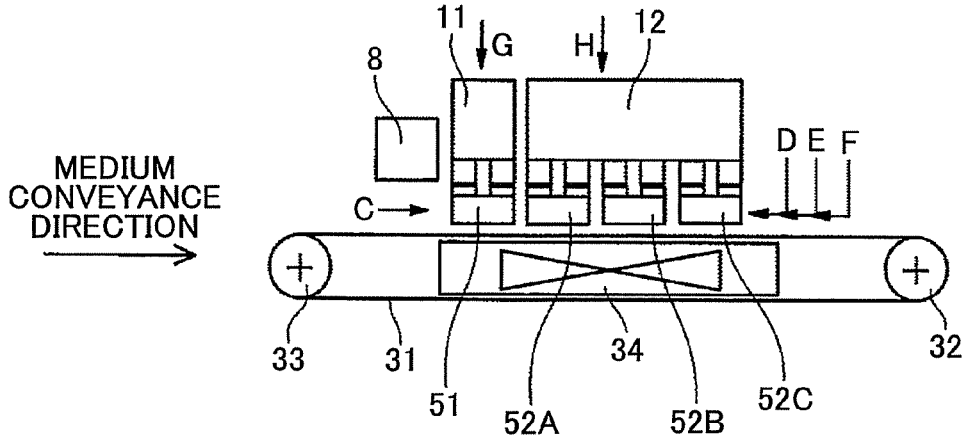

First, referring to FIGS. 12A through 12C, a moisturizing operation is described. As shown in FIG. 12A, at the time of image formation, the respective recording head units 11 and 12 of the image forming part 1 eject desired colors of liquid droplets onto the paper P being conveyed by the conveyance belt 31 in a direction (conveyance direction) as indicated by arrow.

At this time, the first maintenance unit 51 is retracted into and on standby at the position lateral to the first recording head unit 11 on the upstream side of the conveyance direction and at the position above the conveyance part 3. On the other hand, the plural second maintenance units 52A through 52C are retracted into and on standby at the position lateral to the second recording head unit 12 on the downstream side of the conveyance direction in such a manner as to be held in their rising postures on the conveyance part 3 and arranged side by side in the conveyance direction.

In order to bring the image forming apparatus into a print standby state from this state, the respective recording head units 11 and 12 are first moved up in directions as indicated by arrows A and B as shown in FIG. 12B. After this, as shown in FIG. 12C, the first maintenance unit 51 is moved in a direction as indicated by arrow C and placed at the position opposed to the first recording head unit 11, while the second maintenance units 52A through 52C are successively moved in directions as indicated by arrows D, E, and F and placed at the positions opposed to the second head units 12A, 12B, and 12C of the second recording head unit 12, respectively. Then, the respective recording head units 11 and 12 are moved down in directions as indicated by arrows G and H, respectively, and the nozzle surfaces of the respective heads 101 are capped with the cap units 502 to bring the nozzle surfaces of the heads 101 into their moisturized states.

Next, referring to FIGS. 13A through 13C and FIGS. 14A through 14C, a restoration maintenance operation is described.

The restoration maintenance operation includes an idle ejection operation in which liquid droplets are periodically ejected from the heads 101 into the cap units 501 to maintain and restore the heads 101 and a restoration operation in which ink inside the heads 101 is forcibly ejected. Here, as the latter restoration operation, an operation is described in which the nozzle surfaces of the heads 101 are covered with the cap units 501 and the suction pump 503 is driven to suction and eject ink from the nozzles 102. Alternatively, the pressure ejection method described above, a method combining suction ejection with pressure ejection, or the like may be used.

First, when a maintenance signal instructing the restoration operations for all the recording head units 11 and 12 is input to the image forming apparatus when image formation is being performed as shown in FIG. 12A, the image forming apparatus shifts to the maintenance operation by the monochromatic head maintenance unit 51 and successively restores the first recording head unit 11 and the three second head units 12A through 12C. The second maintenance units 52A through 52C are held on standby at the retracted positions because they are not used.

Figure 13A:
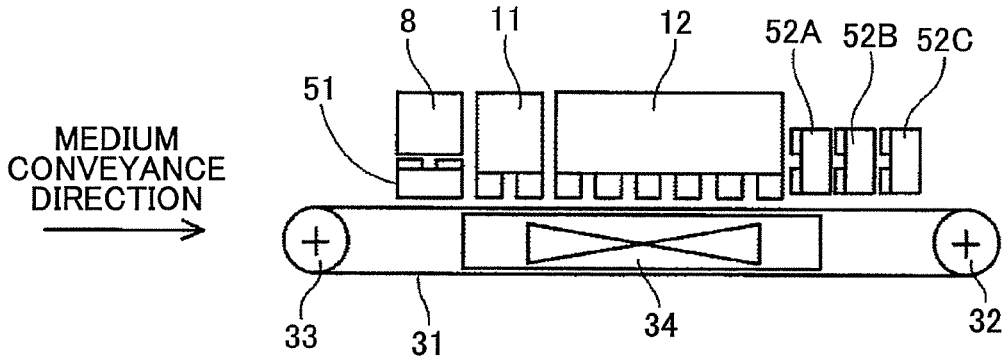
FIGS. 13A through 13C are explanatory views for explaining a restoration maintenance operation in the image forming apparatus.
Figure 13B:
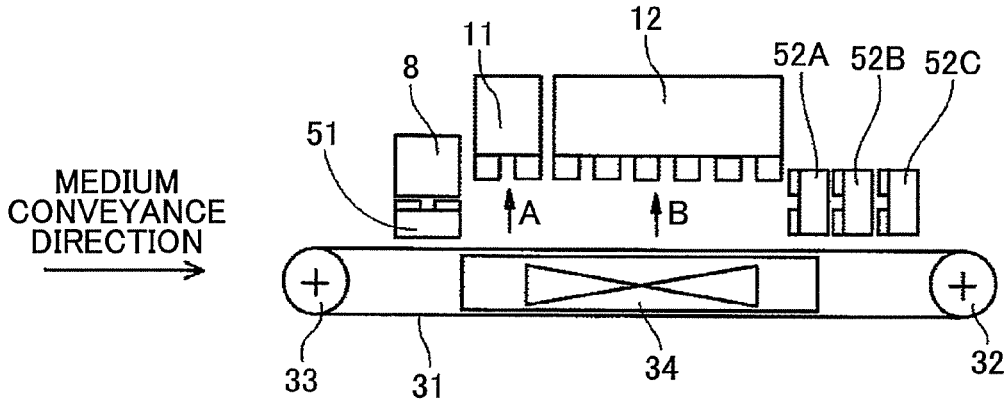
Figure 13C:
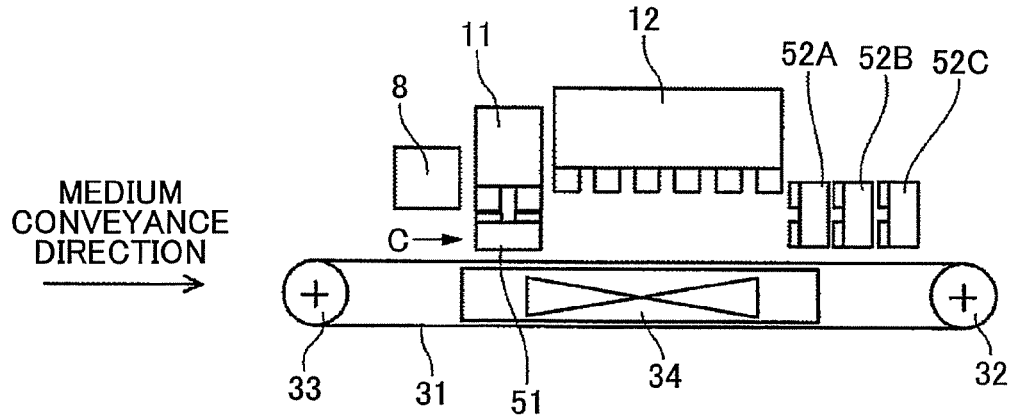

In this restoration operation, as shown in FIG. 13B, the respective recording head units 11 and 12 are moved up in the directions as indicated by the arrows A and B, respectively. Then, as shown in FIG. 13C, the first maintenance unit 51 is moved to the direction as indicated by the arrow C and placed at the position opposed to the first recording head unit 11. Next, the recording head unit 11 is moved down, and the respective heads 101 are capped with the respective cap units 501. Subsequently, the suction pump 503 is driven to suction and eject ink to perform the restoration operation.

Figure 14A:
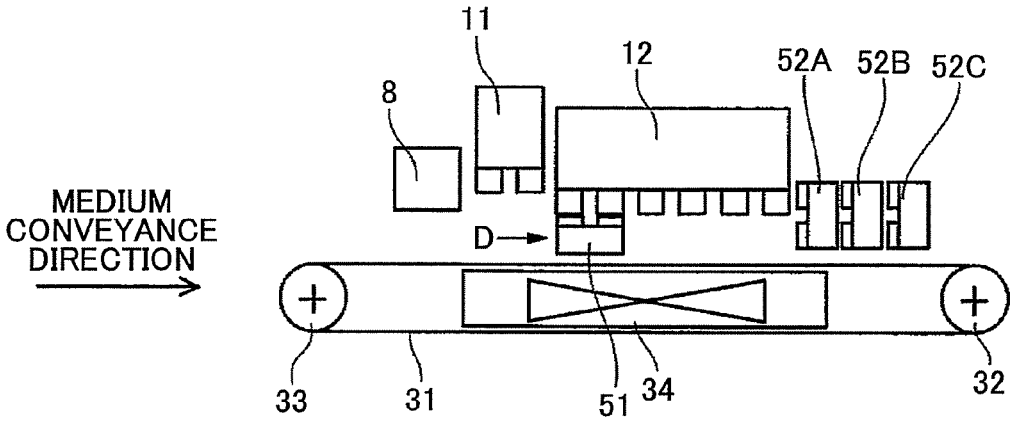
FIGS. 14A through 14C are explanatory views for explaining the restoration maintenance operation following FIGS. 13A through 13C.

When the restoration operation for the first recording head unit 11 is completed, the first recording head unit 11 is moved up as shown in FIG. 14A. Then, the first maintenance unit 51 is moved in a direction as indicated by arrow D and placed at a position opposed to the second head unit 12A. Next, the second recording head unit 12 is moved down, and the respective heads 101 of the second head unit 12A are capped with the respective cap units 501. Subsequently, the suction pump 503 is driven to suction and eject ink to perform the restoration operation.

Figure 14B:
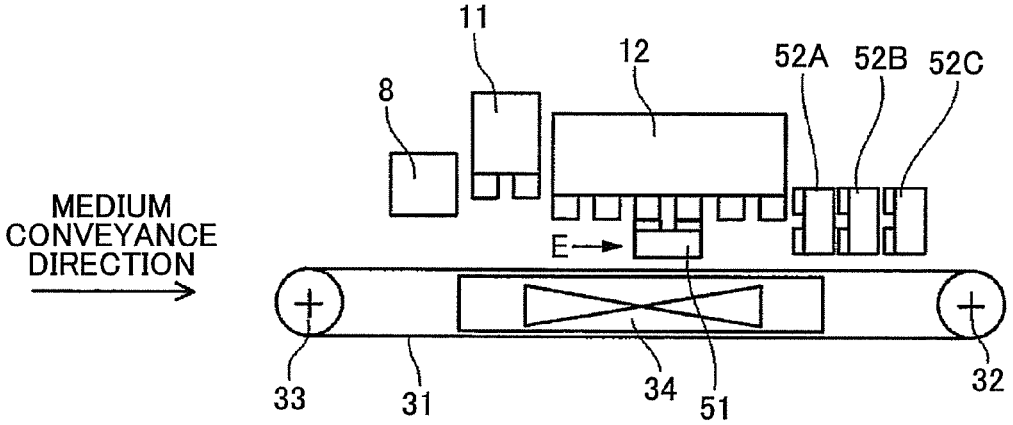

Next, the second recording head unit 12 is temporarily moved up, and the first maintenance unit 51 is moved in a direction as indicated by arrow E and placed at a position opposed to the second head unit 12B as shown in FIG. 14B. Then, the second recording head unit 12 is moved down, and the respective heads 101 of the second head unit 12B are capped with the respective cap units 501. Subsequently, the suction pump 503 is driven to suction and eject ink to perform the restoration operation.

Figure 14C:
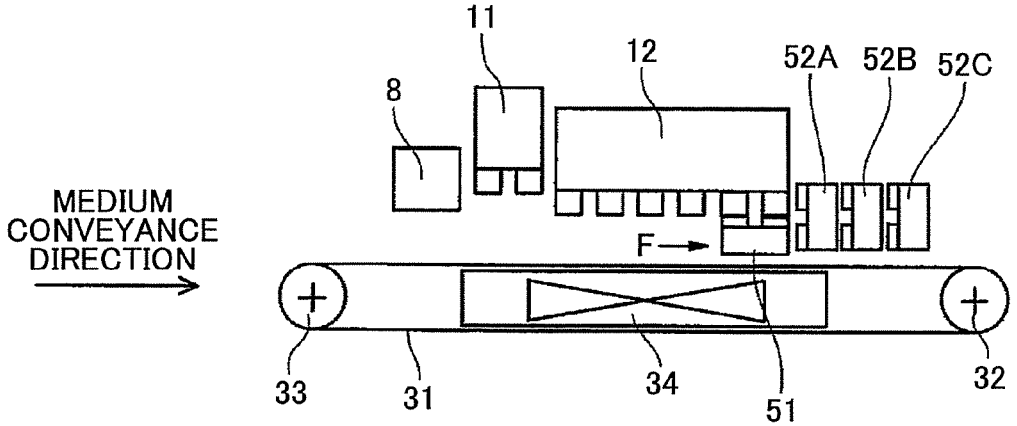

Next, the second recording head unit 12 is temporarily moved up, and the first maintenance unit 51 is moved in a direction as indicated by arrow F and placed at a position opposed to the second head unit 12C as shown in FIG. 14C. Then, the second recording head unit 12 is moved down, and the respective heads 101 of the second head unit 12C are capped with the respective cap units 501. Subsequently, the suction pump 503 is driven to suction and eject ink to perform the restoration operation.

After completing the restoration operations for the first recording head unit 11 and the three second head units 12A through 12C as described above, the first maintenance unit 51 is returned to the retracted position to perform image formation. At this time, the first recording head unit 11 and the three second head units 12A through 12C are moved down to predetermined positions.

The above description refers to a case in which the restoration operations for all of the first recording head unit 11 and the three second head units 12A through 12C are performed. However, where only a specific one of the head units is subjected to the restoration operation, the first maintenance unit 51 may only be moved to a position opposed to the specific head unit.

Figure 15A:
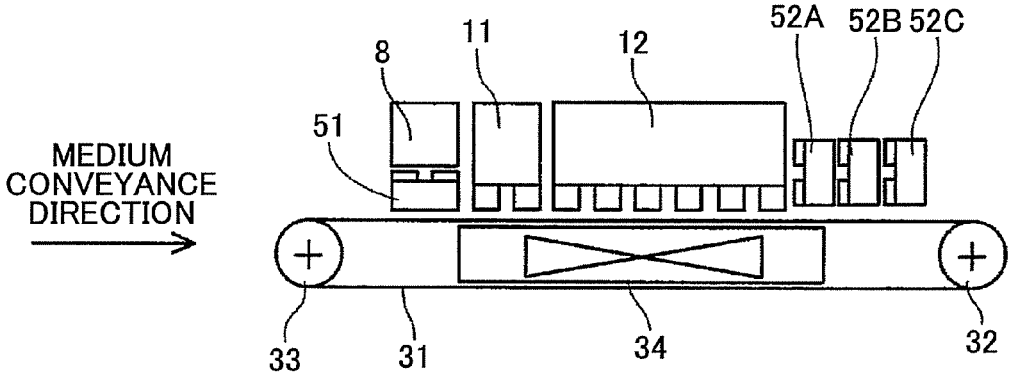
FIGS. 15A through 15C are explanatory views for explaining operations at the time of black-and-white printing and at the time of full-color printing.
Figure 15B:
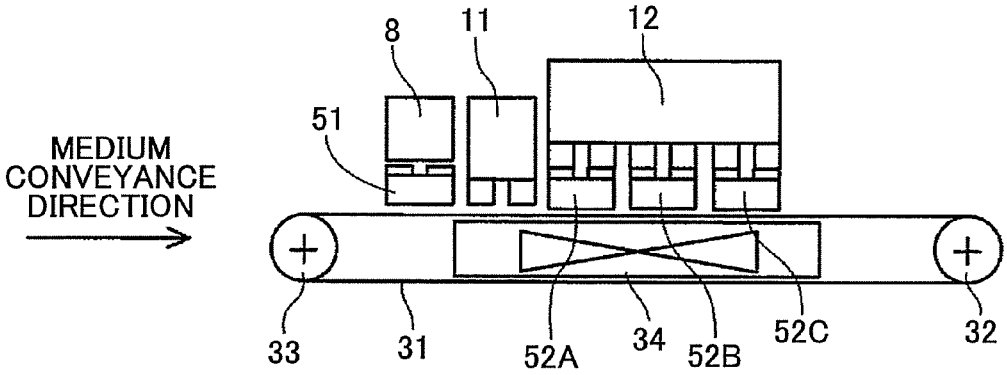
Figure 15C:
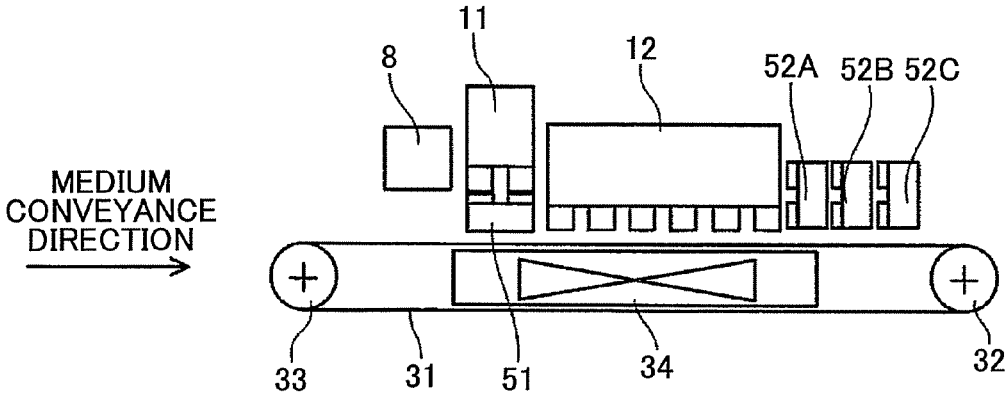

Next, referring to FIGS. 15A through 15C, a description is made of the operations of the image forming apparatus at the times of black-and-white printing and full-color printing. The image forming apparatus is capable of performing full-color printing. However, in the case of printing, for example, text data, the image forming apparatus is only required to perform black-and-white printing and thus does not use the second recording head unit 12 dedicated to color print. Therefore, if the nozzle surfaces of the heads 101 of the unused second recording head unit 12 are left exposed to air, ink inside the nozzles 102 is dried and thus cannot be ejected. As a result, a useless restoration operation is required, thereby uselessly consuming the ink.

As shown in FIG. 15A, in the case of performing full-color printing, the respective head units 11 and 12 of the image forming part 1 are moved down to predetermined positions and eject desired colors of liquid droplets onto the paper P being conveyed by the conveyance belt 31 in a direction (conveyance direction) as indicated by arrow. At this time, the first maintenance unit 51 is retracted into and on standby at the position lateral to the first recording head unit 11 on the upstream side of the conveyance direction and at the position above the conveyance part 3. On the other hand, the plural second maintenance units 52A through 52C are retracted into and on standby at the position lateral to the second recording head unit 12 on the downstream side of the conveyance direction in such a manner as to be held in their rising states above the conveyance part 3 and arranged side by side in the conveyance direction.

Further, as shown in FIG. 15B, in the case of performing black-and-white printing, the first recording head unit 11 of the image forming part 1 is moved down to a predetermined position and ejects black liquid droplets onto the paper P being conveyed by the conveyance belt 31 in a direction (conveyance direction) as indicated by arrow. At this time, the first maintenance unit 51 is retracted into and on standby at the position lateral to the first recording head unit 11 on the upstream side of the conveyance direction and at the position above the conveyance part 3.

Meanwhile, the second recording head unit 12 is not used. Therefore, the plural second maintenance units 52A through 52C are moved to the positions opposed to the respective second head units 12A through 12C of the second recording head unit 12, and the nozzle surfaces of the respective heads 101 are capped with the cap units 501 so as to be brought into their moisturized states. Thus, the respective heads 101 of the second recording head unit 12 are held in their unused states.

Further, if the first recording head unit 11 is required to be brought into its black-and-white printing state, the first recording head unit 11 is restored by the first maintenance unit 51 as shown in FIG. 15C, while the second recording head unit 12 is brought into its operable state to continue black-and-white printing with composite black. Thus, a print speed (productivity) can be improved.

Figure 16A:
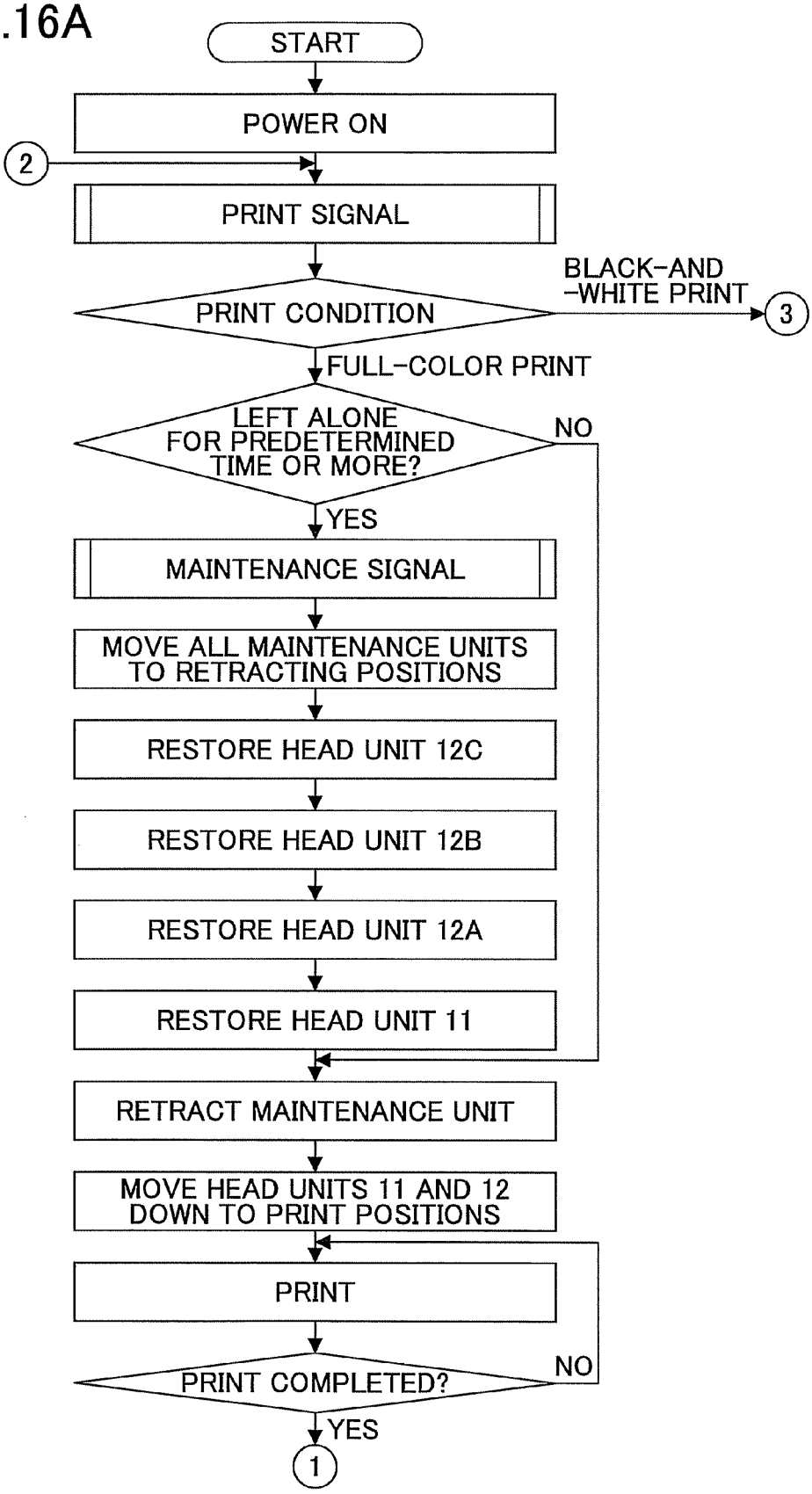
FIGS. 16A and 16B are flowcharts for explaining the entire operations control of the image forming apparatus by the control unit.
Figure 16B:
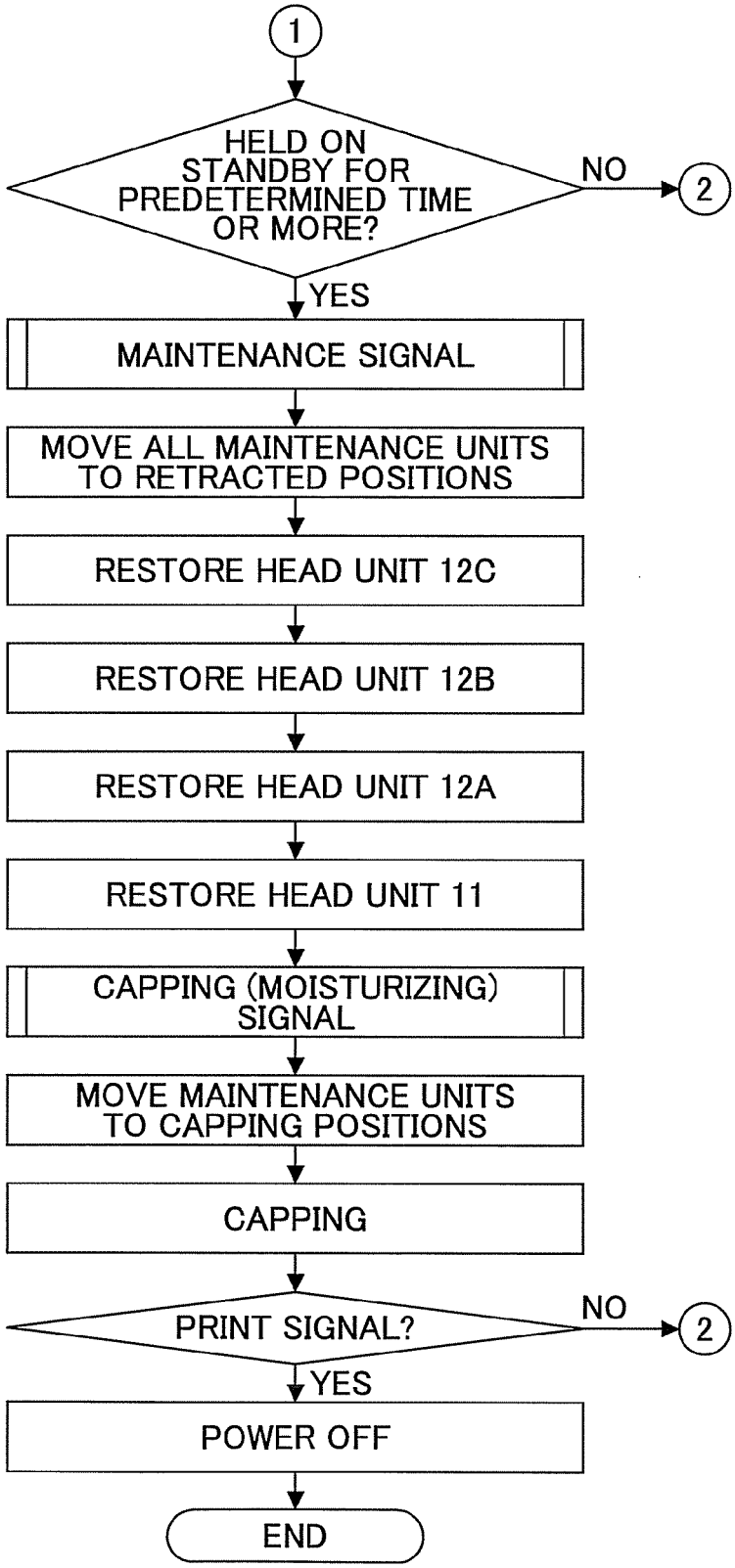
Figure 17:
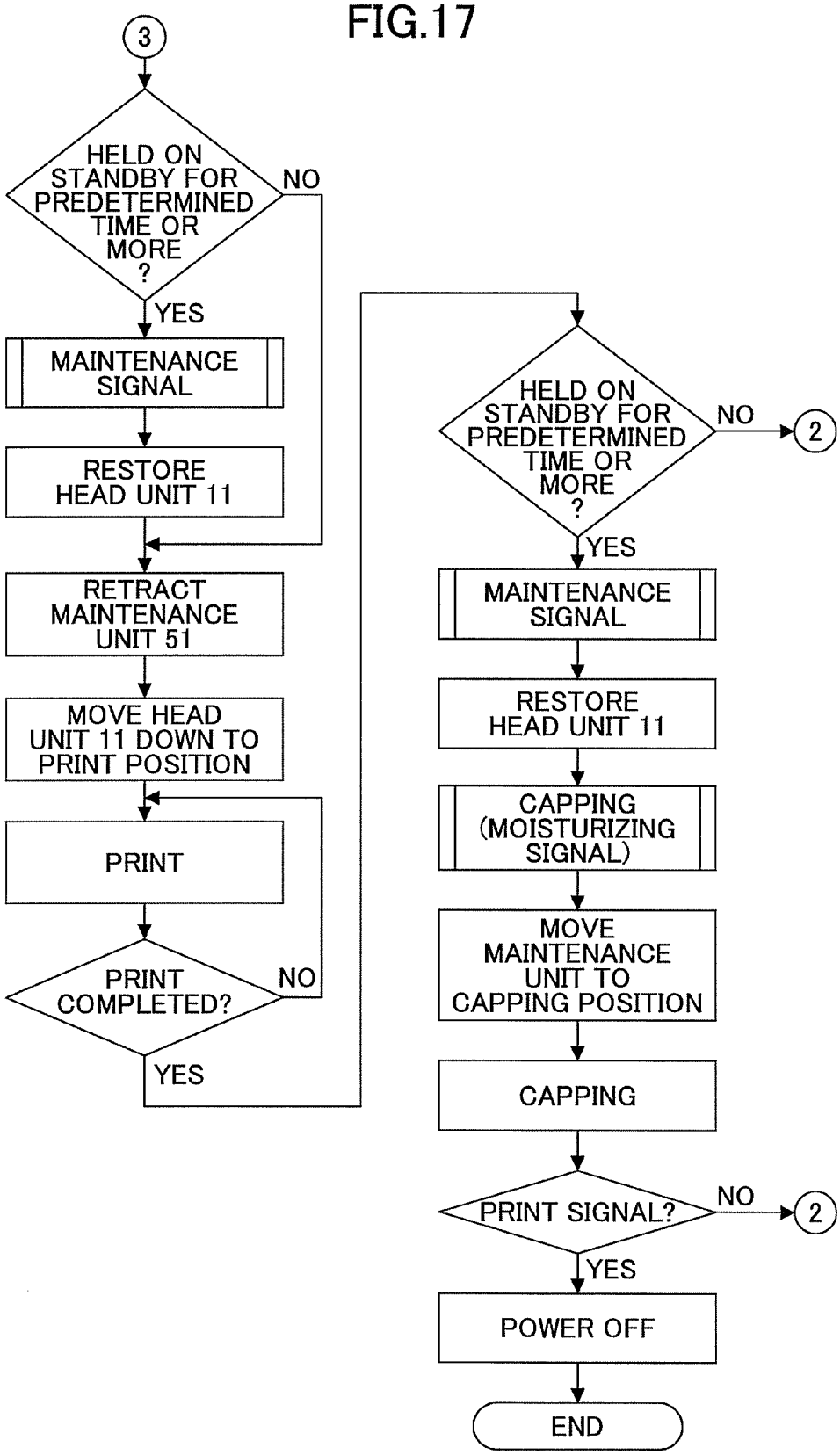
FIG. 17 is a flowchart following FIGS. 16A and 16B.

Next, referring to flowcharts shown in FIGS. 16A and 16B and FIG. 17 and explanatory views shown in FIGS. 18 through 21B, a description is made of controlling the entire operation of the image forming apparatus by the control unit 600. Note that in the following description of control flows, the "first recording head unit 11" is expressed as the "head unit 11," the "second recording head unit 12" is expressed as the "head unit 12," the "second head units 12A through 12C" are expressed as the "head units 12A through 12C," the "first maintenance unit 51" is expressed as the "maintenance unit 51," the "second maintenance unit 52" is expressed as the "maintenance unit 52," and the "maintenance units 52A through 52C" are expressed as the "maintenance units 52A through 52C." Further, in the following description, a restoration operation procedure is different from that described referring to FIGS. 13A through 13C and FIGS. 14A through 14C.

Figure 18:
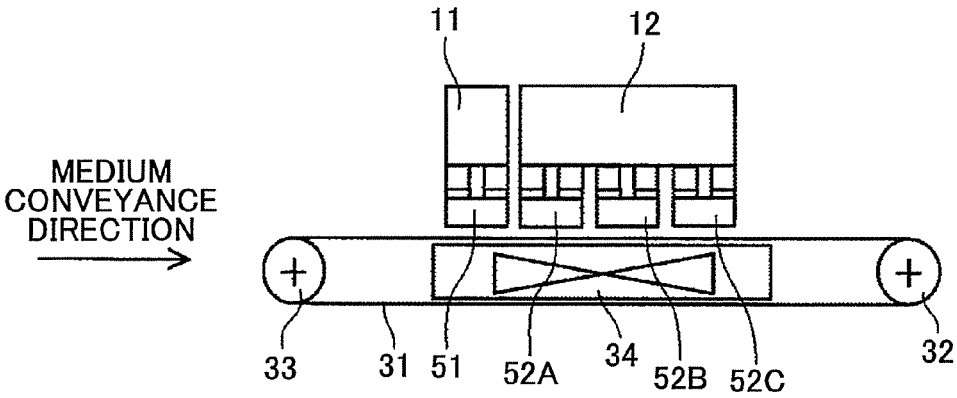
FIG. 18 is an explanatory view for explaining the operations control.

Referring first to FIG. 16A, when the power of the apparatus is turned off, the respective heads 101 of the head unit 11 and the head units 12A through 12C are capped with the cap units 501 of the maintenance units 51 and 52A through 52C (FIG. 18). When a print signal is input to the apparatus in this state, a determination is made as to which one of full-color printing and black-and-white printing is set as a print condition.

Then, where full-color printing is set as the print condition, a determination is made as to whether a predetermined time or more has elapsed (i.e., whether the apparatus has been left alone for the predetermined time or more) since the last usage of the apparatus. If the apparatus has been left alone for the predetermined time or more, a maintenance signal is input to the apparatus and thus the apparatus is brought into the state of the maintenance operation.

Figure 19A:
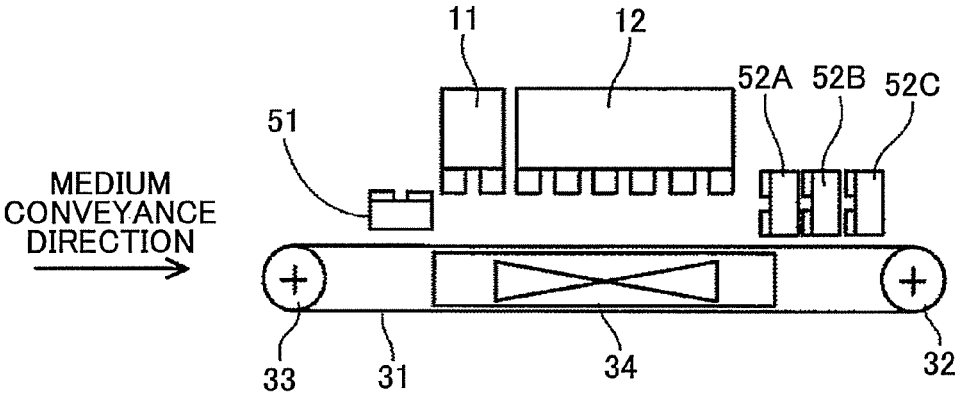
FIGS. 19A through 19D are explanatory views for explaining the operations control.
Figure 19B:
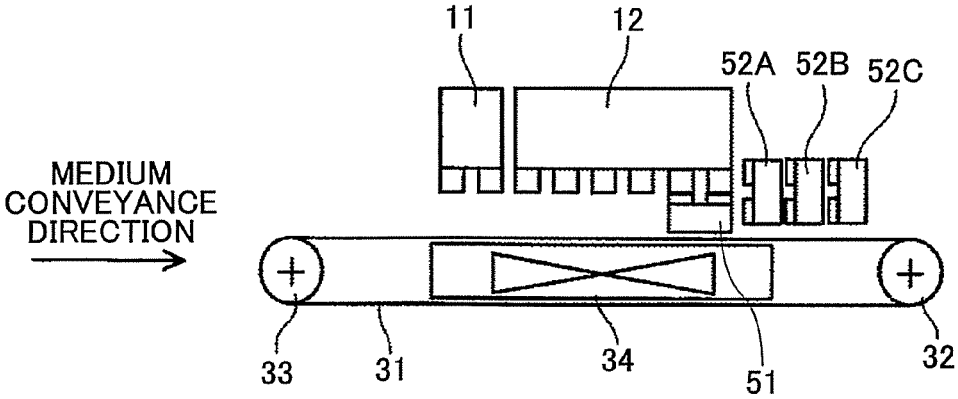
Figure 19C:
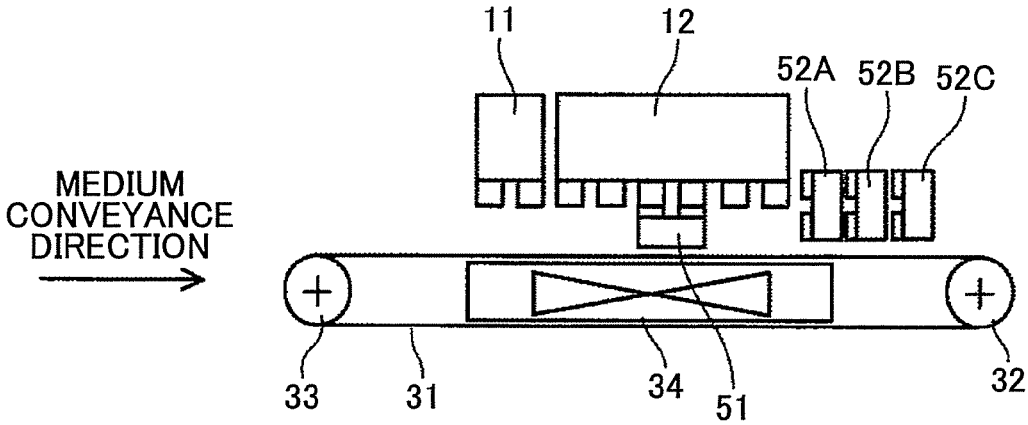
Figure 19D:
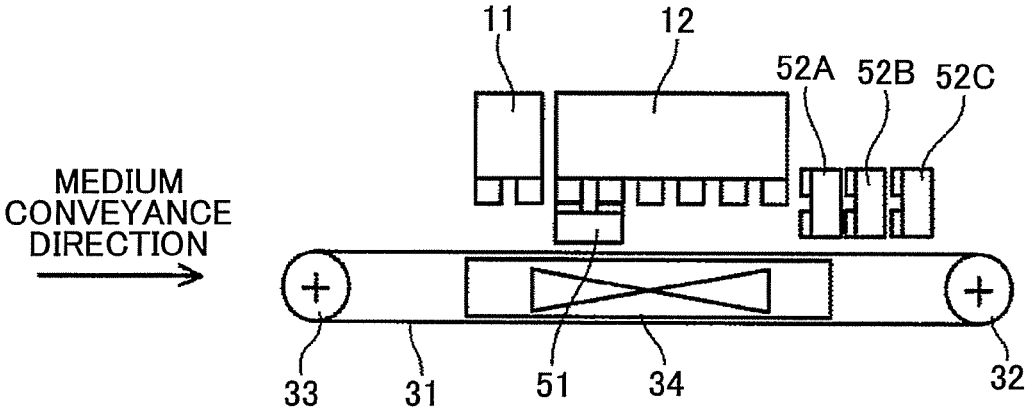
Figure 20A:
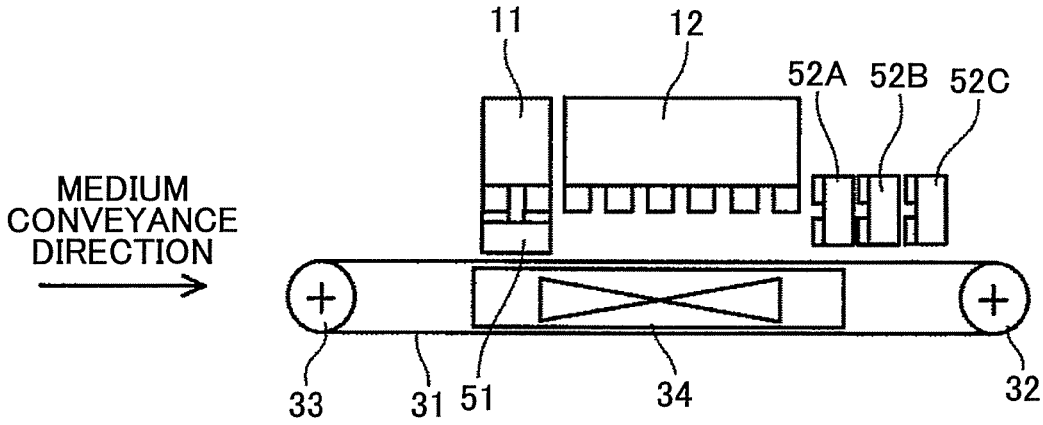
FIGS. 20A and 21B are explanatory views for explaining the operations control.
Figure 20B:
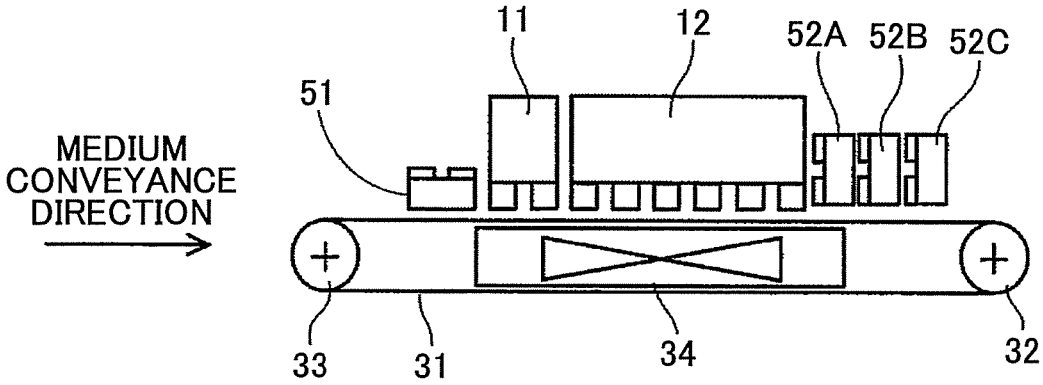

First, all the maintenance units 51 and 52A through 52C move to the retracted positions, and the head units 11 and 12A through 12C move upward (FIG. 19A). In this state, the maintenance unit 51 first moves to the position opposed to the head unit 12C and performs the restoration operation on the head unit 12C (FIG. 19B). Then, the maintenance unit 51 moves to the position opposed to the head unit 12B and performs the restoration operation on the head nit 12B (FIG. 19C). Next, the maintenance unit 51 moves to the position opposed to the head unit 12A and performs the restoration operation on the head unit 12A (FIG. 19D). Subsequently, the maintenance unit 51 moves to the position opposed to the head unit 11 and performs the restoration operation on the head unit 11 (FIG. 20A). After the maintenance unit 51 retracts into the retracted position, the head units 11 and 12A through 12C move down to the print positions to be brought into the state of the print operation (FIG. 20B).

If the apparatus has been held on standby for a predetermined time or more until a next job signal (print data) is input to the apparatus after the print operation, the apparatus is brought into the state of the maintenance operation. In this case, the maintenance unit 51 performs the restoration operations on the head units in the order from the head unit 12C to the head unit 11 through the head units 12B and 12A in the same manner as the above. After this, the apparatus receives a capping signal and then caps the respective heads 101 of the head units 11 and 12A through 12C with the cap units 501 of the maintenance units 51 and 52A through 52C so as to be moisturized (state shown in FIG. 18).

On the other hand, if the next print signal is input to the apparatus before the apparatus has been held on standby for the predetermined time or more, the apparatus is directly brought into the state of the print operation. If the next print signal is not input to the apparatus after the head units are capped with the cap units 501 and the usage of the apparatus is completed, the power of the apparatus is turned off.

Meanwhile, referring to FIG. 17, where black-and-white printing is set as the print condition, a determination is made as to whether a predetermined time or more has elapsed (i.e., whether the apparatus has been left alone for the predetermined time or more) since the last usage of the apparatus. If the apparatus has been left alone for the predetermined time or more, the maintenance signal is input to the apparatus and thus the apparatus is brought into the state of the maintenance operation.

Figure 21A:
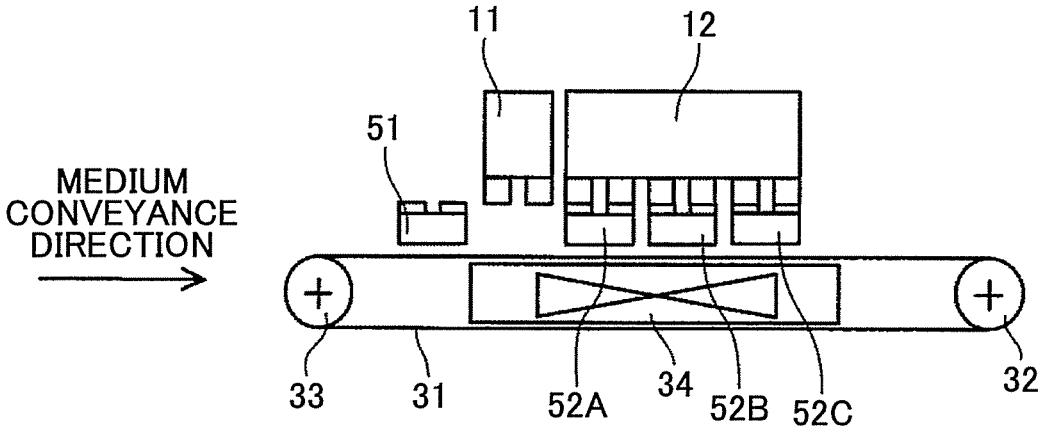
Figure 21B:
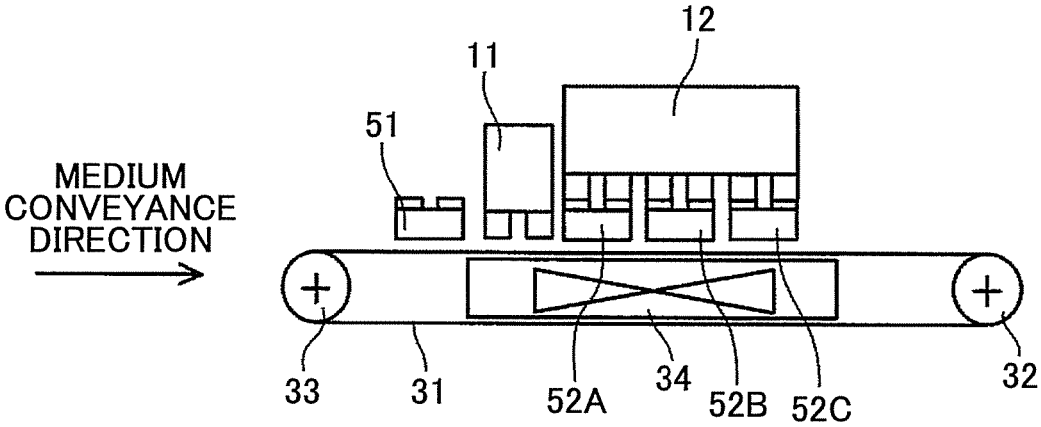

First, the maintenance unit 51 performs the restoration operation on the head unit 11 and then moves to the retracted position (FIG. 21A). After the maintenance unit 51 retracts into the retracted position, the head unit 11 moves down to be brought into the state of the print operation (FIG. 21B).

If the apparatus has been held on standby for a predetermined time or more until a next job signal (print data) is input to the apparatus after the print operation, the apparatus is brought into the state of the maintenance operation. In this case, the maintenance unit 51 performs the restoration operations on the head units in the same manner as the above. After this, the apparatus receives a capping signal and then caps the respective heads 101 of the head unit 11 with the cap units 501 of the maintenance unit 51 so as to be moisturized (state shown in FIGS. 19A through 19D).

On the other hand, if the next print signal is input to the apparatus before the apparatus has been held on standby for the predetermined time or more, the apparatus is directly brought into the state of the print operation. If the next print signal is not input to the apparatus after the head units are capped with the cap units 501 and thus the usage of the apparatus is completed, the power of the apparatus is turned off.

Note that at the time of black-and-white printing, the maintenance units 52A through 52C are held in their capping states so as to moisturize the head units 12A through 12C.

Figure 22:
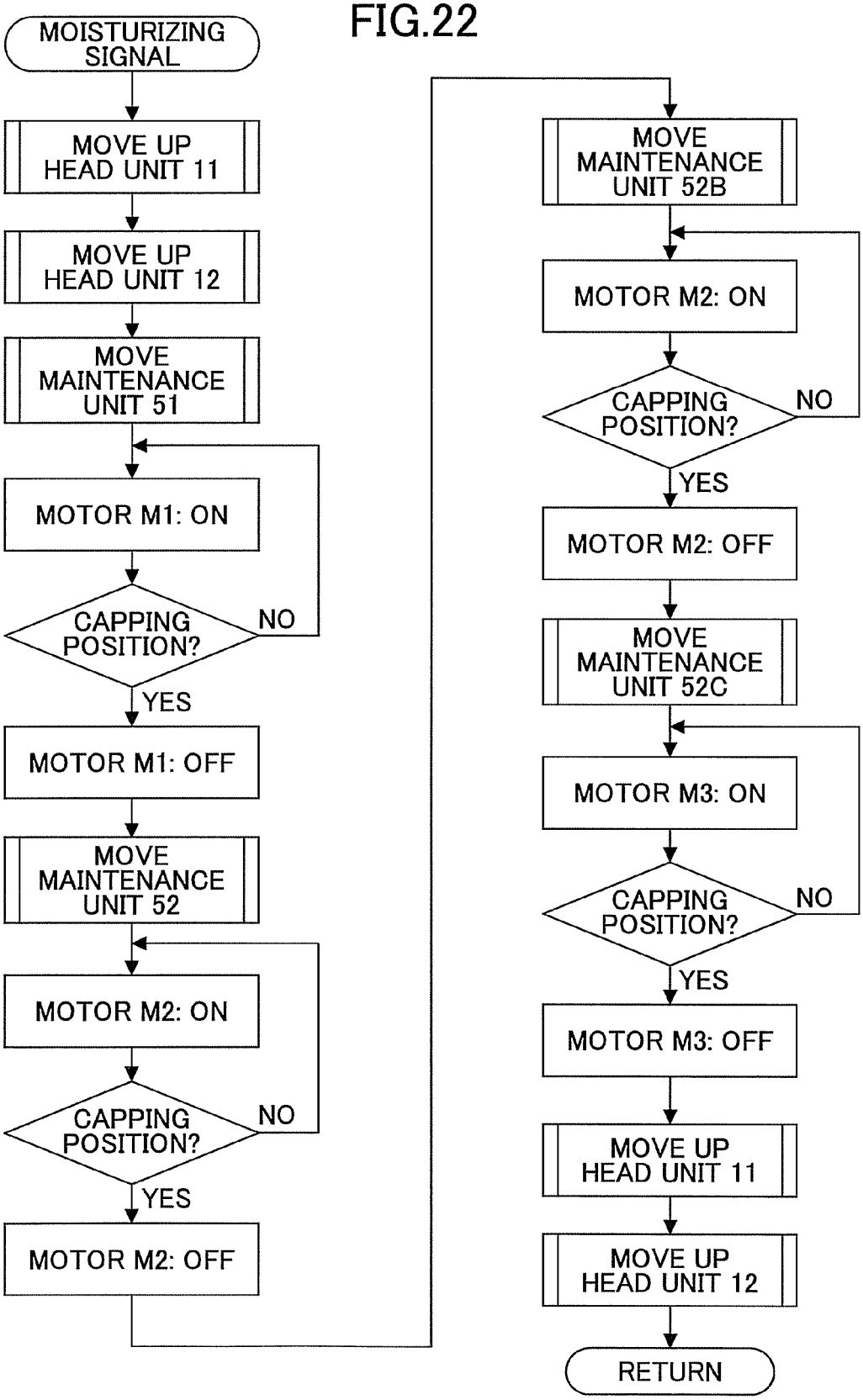
FIG. 22 is a flowchart for explaining moisturizing operations control of the image forming apparatus.

Next, referring to a flowchart shown in FIG. 22, a description is made of operations control when a signal for bringing the heads 101 into their moisturized state is input to the apparatus being held in its print state.

First, the head unit 11 is moved up, and then the head unit 12 is moved up. Next, the motor 515 (expressed as the motor M1) of the maintenance unit 51 is driven. When the maintenance unit 51 is moved to the position where the head unit 11 is to be capped, the driving of the motor M1 is stopped.

Then, the motor 515 (expressed as the motor M2) of the maintenance unit 52A is driven. When the maintenance unit 52A is moved to the position where the head unit 12A is to be capped, the driving of the motor M2 is stopped. Next, the motor 515 (expressed as the motor M3) of the maintenance unit 52B is driven. When the maintenance unit 52B is moved to the position where the head unit 12B is to be capped, the driving of the motor M3 is stopped. Then, the motor 515 (expressed as the motor M4) of the maintenance unit 52C is driven. When the maintenance unit 52C is moved to the position where the head unit 12C is to be capped, the driving of the motor M4 is stopped.

Next, the head unit 11 is moved down and then the head unit 12 is moved down so as to be capped with the maintenance units 51 and 52, respectively.

Next, referring to flowcharts shown in FIGS. 23 through 27, a description is made of controlling the restoration operations (maintenance).

Figure 23:
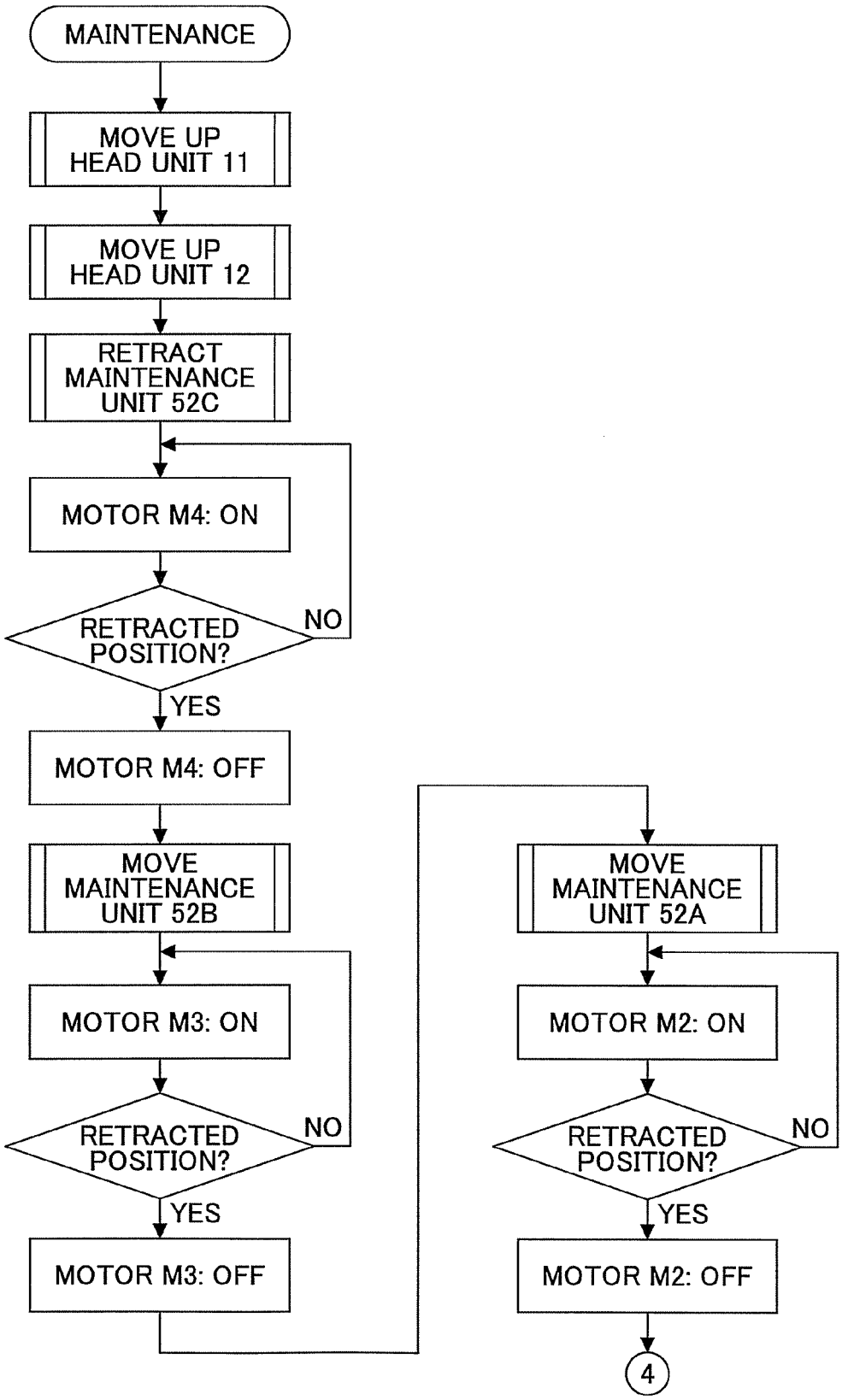
FIG. 23 is a flowchart for explaining maintenance operations control of the image forming apparatus.

First, referring to FIG. 23, the head unit 11 is moved up, and then the head unit 12 is moved up. Next, the motor 515 (motor M4) of the maintenance unit 52 is driven. When the maintenance unit 52C is moved to the retracted position, the driving of the motor M4 is stopped. Then, the motor 515 (motor M3) of the maintenance unit 52B is driven. When the maintenance unit 52B is moved to the retracted position, the driving of the motor M3 is stopped. Next, the motor 515 (motor M2) of the maintenance unit 52A is driven. When the maintenance unit 52A is moved to the retracted position, the driving of the motor M2 is stopped.

In the manner described above, the maintenance units 52C, 52B, and 52A are successively moved to their retracted positions.

Figure 24:
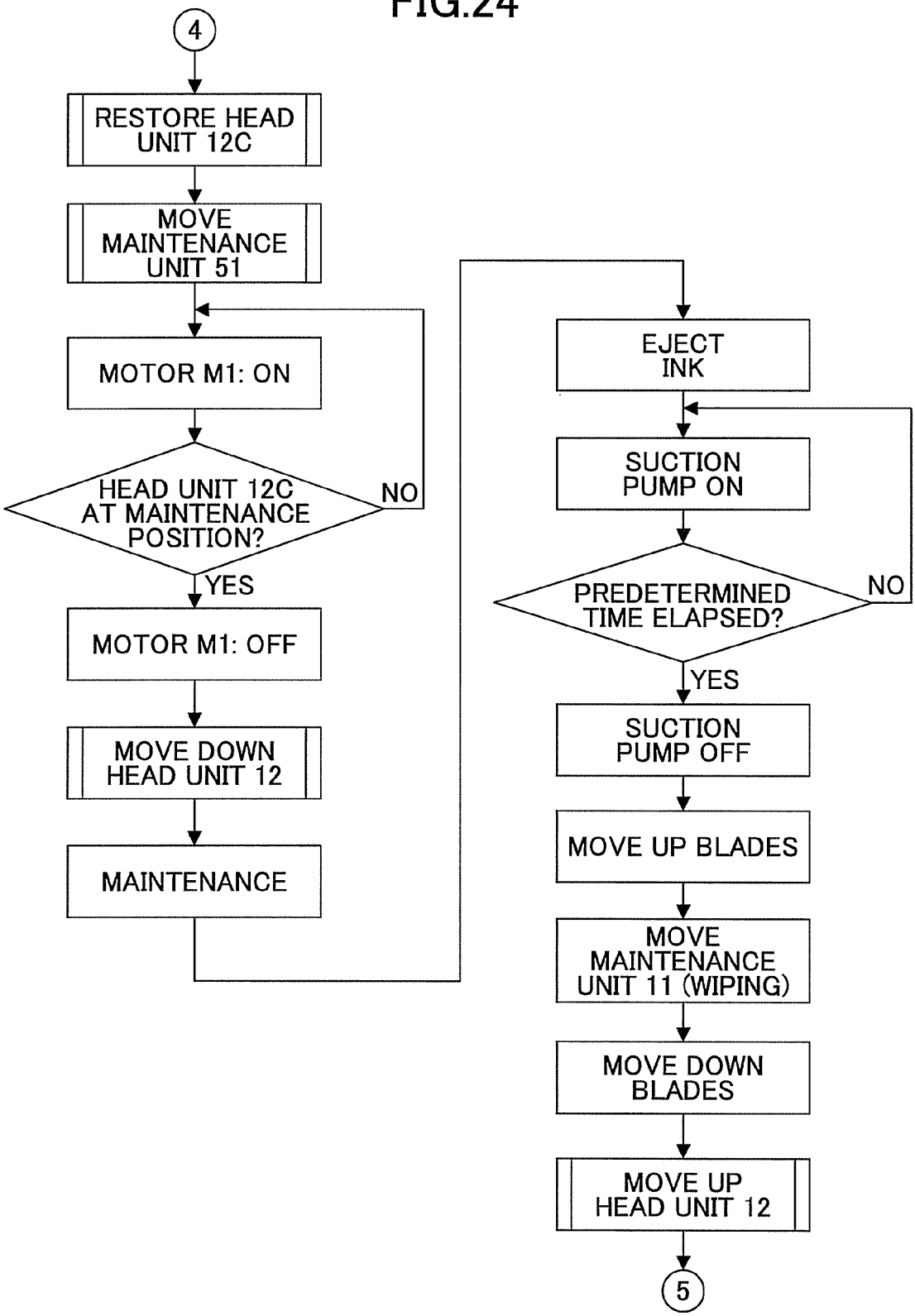
FIG. 24 is a flowchart following FIG. 23.

Then, referring to FIG. 24, the motor 515 (motor M1) of the maintenance unit 51 is driven. When the maintenance unit 51 is moved to the maintenance position of the head unit 12C, the driving of the motor M1 is stopped. Next, the head unit 12 is moved down, and ink is ejected from the respective heads 101 of the head unit 12C. After the suction pump 503 is operated for a certain time, the blade units 502 are moved up and the maintenance unit 51 is moved to wipe off the nozzle surfaces. Then, the blade units 502 are moved down, and the head unit 12 is moved up.

Figure 25:
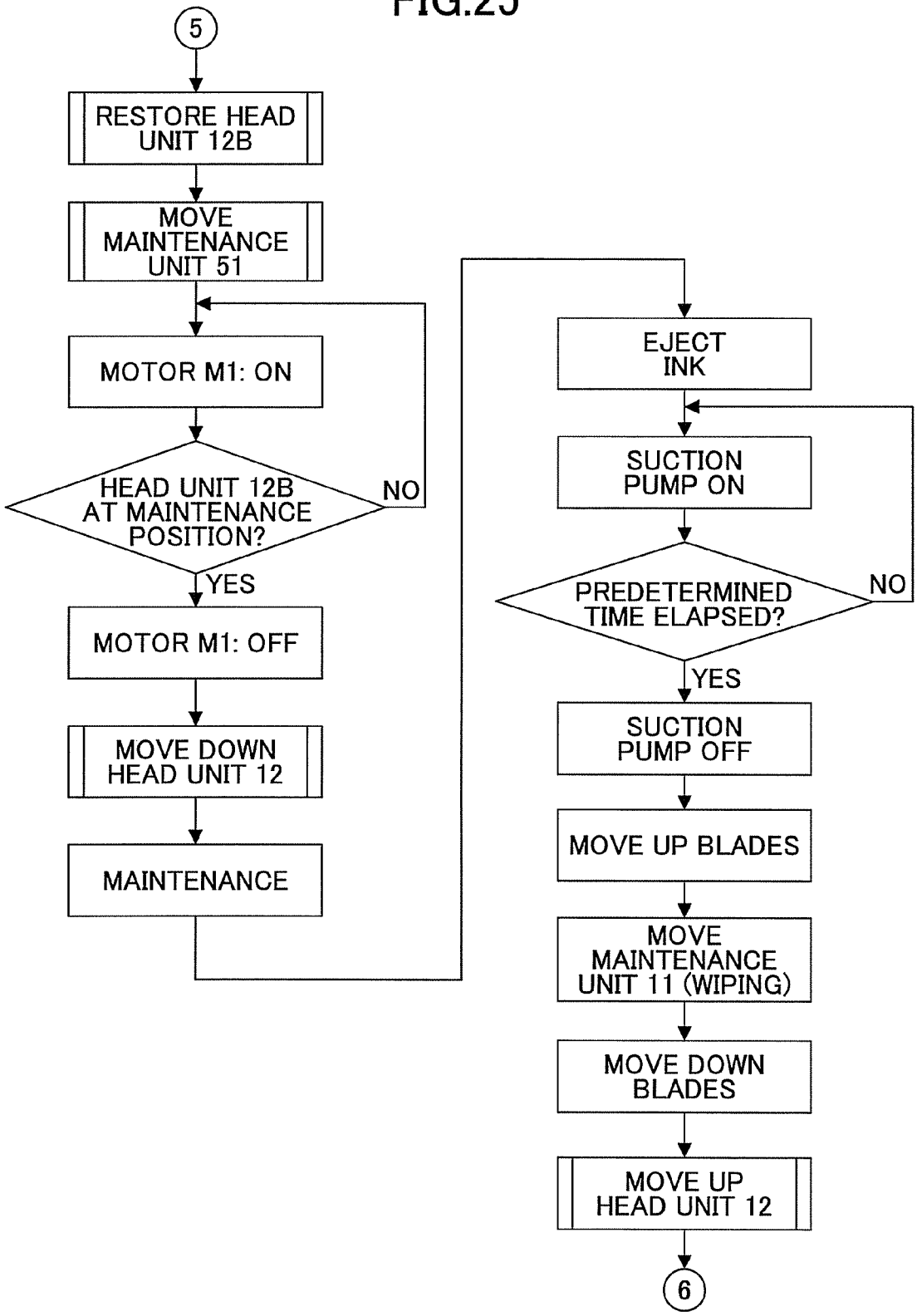
FIG. 25 is a flowchart following FIG. 24.

Next, referring to FIG. 25, the motor 515 (motor M1) of the maintenance unit 51 is driven. When the maintenance unit 51 is moved to the maintenance position of the head unit 12B, the driving of the motor M1 is stopped. Then, the head unit 12 is moved down, and ink is ejected from the respective heads 101 of the head unit 12B. After the suction pump 503 is operated for a certain time, the blade units 502 are moved up and the maintenance unit 51 is moved to wipe off the nozzle surfaces. Then, the blade units 502 are moved down, and the head unit 12 is moved up.

Figure 26:
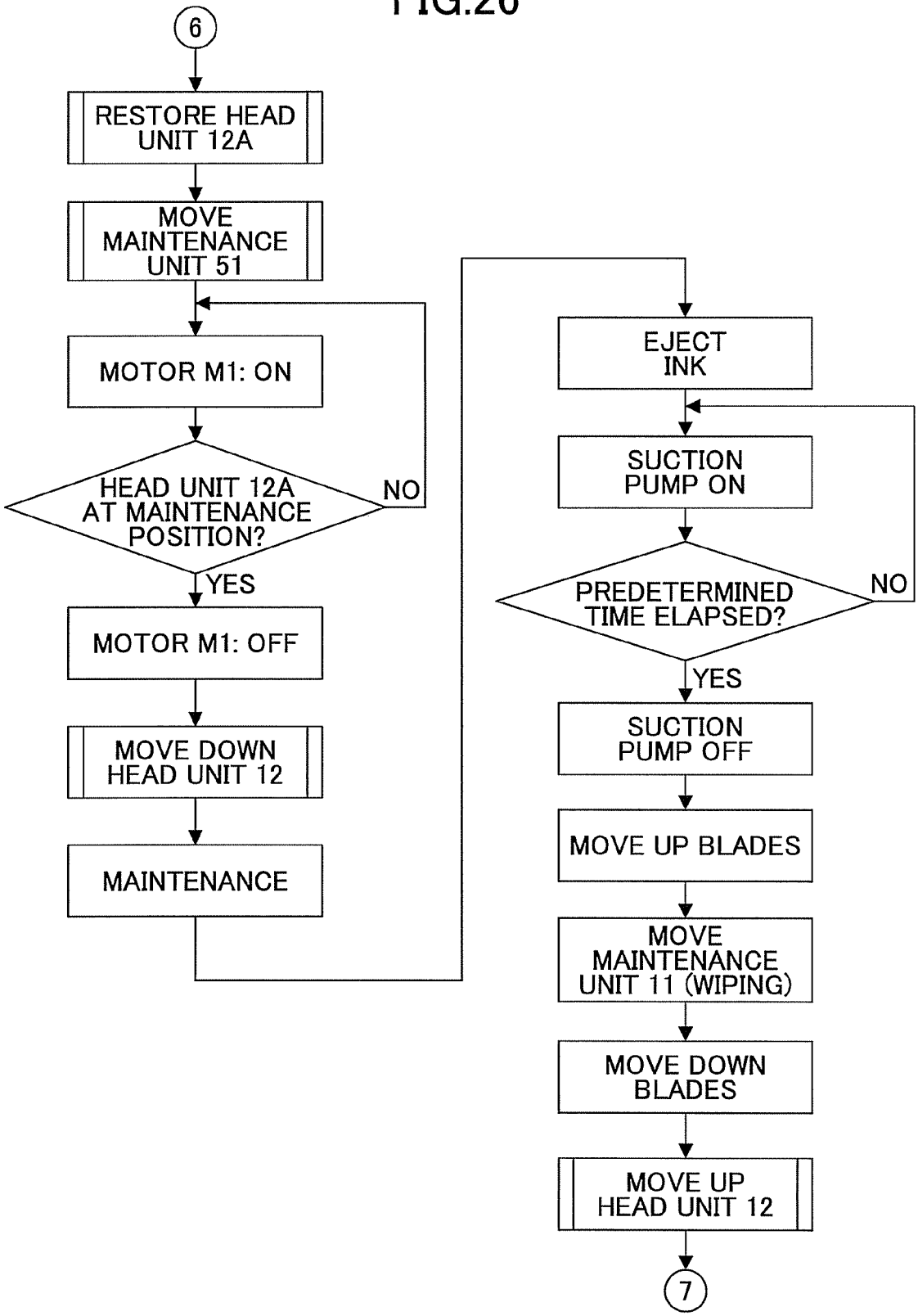
FIG. 26 is a flowchart following FIG. 25.

Next, referring to FIG. 26, the motor 515 (motor M1) of the maintenance unit 51 is driven. When the maintenance unit 51 is moved to the maintenance position of the head unit 12A, the driving of the motor M1 is stopped. Then, the head unit 12 is moved down, and ink is ejected from the respective heads 101 of the head unit 12A. After the suction pump 503 is operated for a certain time, the blade units 502 are moved up and the maintenance unit 51 is moved to wipe off the nozzle surfaces. Then, the blade units 502 are moved down, and the head unit 12 is moved up.

Figure 27:
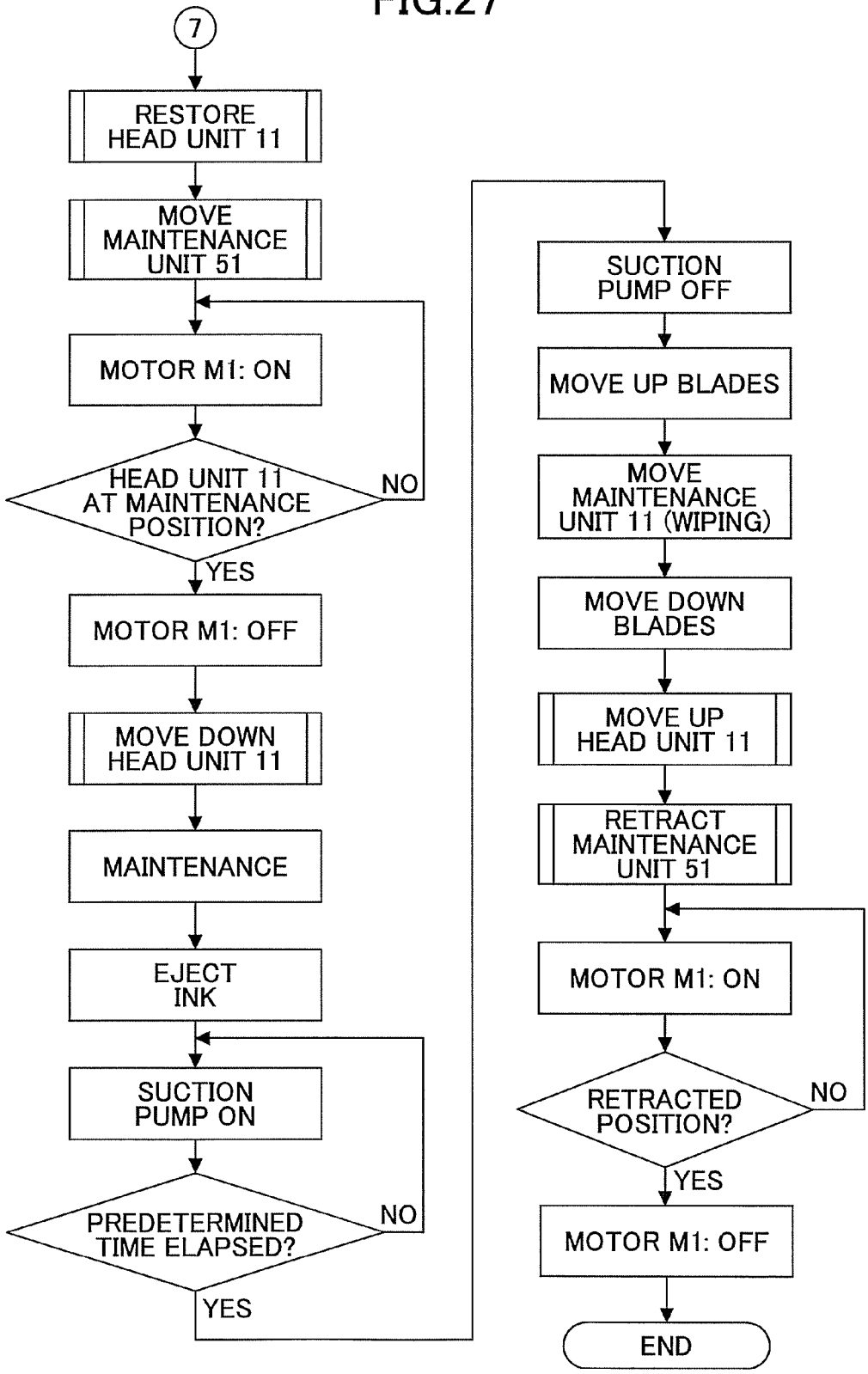
FIG. 27 is a flowchart following FIG. 26.

Next, referring to FIG. 27, the motor 515 (motor M1) of the maintenance unit 51 is driven. When the maintenance unit 51 is moved to the maintenance position of the head unit 11, the driving of the motor M1 is stopped. Then, the head unit 11 is moved down, and ink is ejected from the respective heads 101 of the head unit 11. After the suction pump 503 is operated for a certain time, the blade units 502 are moved up and the maintenance unit 51 is moved to wipe off the nozzle surfaces. Then, the blade units 502 are moved down, and the head unit 12 is moved up.

Next, the motor 515 (motor M1) of the maintenance unit 51 is driven to move the maintenance unit 51 to the retracted position.

Figure 28A:
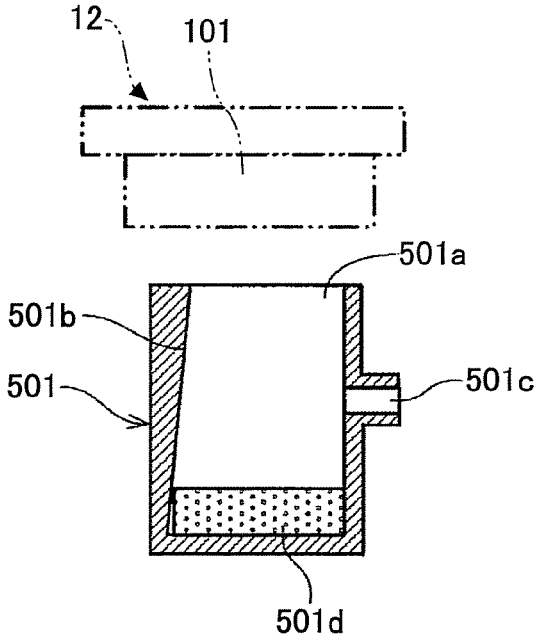
FIGS. 28A and 28B are explanatory views for explaining an example of a cap unit of the second maintenance units.
Figure 28B:
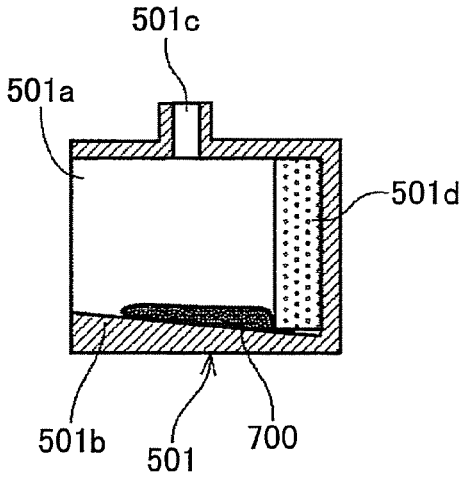

Next, referring to FIGS. 28A and 28B, a description is made of the cap units 501 of the second maintenance units 52A through 52C.

As described above, the second maintenance units 52A through 52C are on standby at the retracted positions with the cap units 501 directed in a lateral direction. Therefore, as shown in FIGS. 28A and 28B, the cap units 501 have ink-flowing prevention parts 501*b*, which are inclined from bottom parts to opening parts 501*a*, provided at their surfaces forming the bottom sides when the cap units 501 are moved to the retracted positions. Further, the cap units 501 have air communication holes 501*c* formed in wall surfaces opposite to the ink-flowing prevention parts 501*b* and have absorption members 501*d* provided at the bottom parts.

Accordingly, when the cap units 501 are shifted from their capping states (states where the cap units 501 are opposed to the head unit 12) as shown in FIG. 28A to their standby states as shown in FIG. 28B, ink ejected into the cap units 501 can be prevented from flowing from the opening parts 501*a*.

Figure 29:
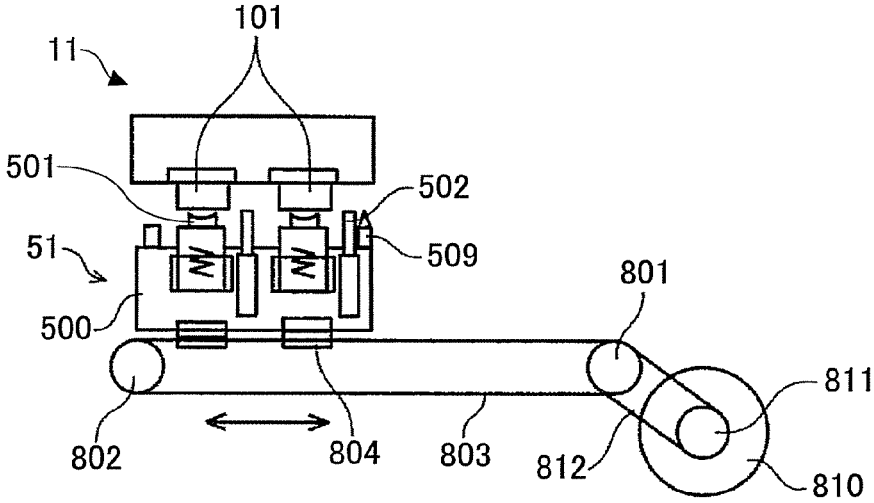
FIG. 29 is an explanatory view for explaining the other example of the moving mechanism of the first maintenance unit.

Next, referring to FIG. 29, a description is made of the other example of the moving mechanism of the first maintenance unit 51. Here, the first maintenance unit 51 is connected to a timing belt 803 bridged across a driving pulley 801 and a driven pulley 802 through a slider 804, and the driving pulley 801 is rotated and driven by a driving motor 810 through a timing belt 812 bridged across the driving pulley 801 and a motor pulley 811. Note here that the maintenance unit 51 has the positioning pin 509 in the same manner as the maintenance units 52A through 52C to align the maintenance unit 51 with the head unit 11.

The present invention is not limited to the specifically disclosed embodiments, and variations and modifications may be made without departing from the scope of the present invention.

The present application is based on Japanese Priority Application No. 2010-053072 filed on Mar. 10, 2010, the entire contents of which are hereby incorporated herein by reference.

What is claimed is:

1. An image forming apparatus comprising:

plural recording heads that eject liquid droplets onto a recording medium traveling in a medium conveyance direction; and plural maintenance units that correspond to the plural recording heads and have respective cap surfaces that oppose the recording heads, respectively; wherein the plural maintenance units are capable of separately moving between opposed positions opposed to the plural recording heads and retracted positions not opposed to the plural recording heads, the plural maintenance units are retracted into the retracted positions in postures different from opposed postures at the opposed positions opposed to the plural recording heads, the plural maintenance units are retracted into the retracted positions in the retracted postures in which the plural maintenance units are rotated by 90 degrees from the opposed postures at the opposed positions, and the plural maintenance units in the retracted postures at the retracted positions are arranged laterally side by side in parallel where all of the respective cap surfaces of the plural maintenance units are directed in the medium conveyance direction.

2. An image forming apparatus comprising:

a first recording head that ejects monochromatic liquid droplets onto a recording medium traveling in a medium conveyance direction;

a second recording head that ejects plural different colors of liquid droplets onto the recording medium traveling in the conveyance direction;

a first maintenance unit that corresponds to the first recording head; and plural second maintenance units that correspond to the second recording head and have respective cap surfaces that oppose the second recording head; wherein the first maintenance unit is capable of moving between an opposed position opposed to the first recording head and a retracted position not opposed to the first recording head, the plural second maintenance units are capable of separately moving between opposed positions opposed to the second recording head and retracted positions not opposed to the second recording head, the plural second maintenance units are retracted into the retracted positions in postures different from opposed postures at the opposed positions opposed to the second recording head, the plural second maintenance units are retracted into the retracted positions in the retracted postures in which the plural second maintenance units are rotated by 90 degrees from the opposed postures at the opposed positions, and the plural second maintenance units in the retracted postures at the retracted positions are arranged laterally side by side in parallel where all of the respective cap surfaces of the plural second maintenance units are directed in the medium conveyance direction.

3. The image forming apparatus according to claim 2, wherein at least one of the first maintenance unit and the plural second maintenance units has a cap unit that caps nozzle surfaces and a blade unit that wipes off the nozzle surfaces.

4. The image forming apparatus according to claim 2, wherein at least one of the first maintenance unit and the plural second maintenance units has a cap unit that caps nozzle surfaces and a made unit that wipes off the nozzle surfaces, and the other of the first maintenance unit and the plural second maintenance units has only the cap unit.

* * * * *